US011732916B2

(12) United States Patent
Butler et al.

(10) Patent No.: US 11,732,916 B2
(45) Date of Patent: Aug. 22, 2023

(54) REFRIGERATION LEAK DETECTION

(71) Applicant: Emerson Climate Technologies, Inc., Sidney, OH (US)

(72) Inventors: Brian R. Butler, Centerville, OH (US); Stuart K. Morgan, West Chester, OH (US); Hung Pham, Dayton, OH (US); Winfield S. Morter, Sidney, OH (US); Andrew M. Welch, Sidney, OH (US); David Alfano, Sidney, OH (US); Michael A. Saunders, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 38 days.

(21) Appl. No.: 16/940,808

(22) Filed: Jul. 28, 2020

(65) Prior Publication Data

US 2021/0381708 A1 Dec. 9, 2021

Related U.S. Application Data

(60) Provisional application No. 63/036,193, filed on Jun. 8, 2020.

(51) Int. Cl.
*F24F 11/36* (2018.01)
*F24F 11/84* (2018.01)
(Continued)

(52) U.S. Cl.
CPC ..... *F24F 11/36* (2018.01); *F24F 11/52* (2018.01); *F24F 11/58* (2018.01); *F24F 11/84* (2018.01);
(Continued)

(58) Field of Classification Search
CPC ..... F24F 11/0076; F24F 11/001; F24F 2011/0052; F25B 31/00
See application file for complete search history.

(56) References Cited

U.S. PATENT DOCUMENTS 4,191,023 A 3/1980 Sisk et al.
4,384,608 A 5/1983 Scarlett et al.
(Continued)

FOREIGN PATENT DOCUMENTS

EP 1970651 A1 9/2008
EP 3051236 A1 8/2016
(Continued)

OTHER PUBLICATIONS

Danfoss Application Guide: "Gas Detection in Refrigeration Systems", 2018.
(Continued)

*Primary Examiner* — Nelson J Nieves
*Assistant Examiner* — Meraj A Shaikh
(74) *Attorney, Agent, or Firm* — Harness, Dickey & Pierce, P.L.C.

(57) ABSTRACT

A refrigerant control system includes: a charge module configured to determine an amount of refrigerant that is present within a first portion of a refrigeration system within a building; and an isolation module configured to selectively open and close an isolation valve of the refrigeration system and to, via the isolation valve, maintain the amount of refrigerant within the first portion within the building below a predetermined amount of the refrigerant.

19 Claims, 15 Drawing Sheets

(51) Int. Cl.

| | |
|---|---|
| ***F24F 11/52*** | (2018.01) |
| ***F24F 11/58*** | (2018.01) |
| ***F24F 11/86*** | (2018.01) |
| *F24F 140/12* | (2018.01) |
| *F24F 140/20* | (2018.01) |

(52) U.S. Cl.
CPC ..... *F24F 11/86* (2018.01); *F24F 2140/12* (2018.01); *F24F 2140/20* (2018.01)

(56) References Cited

U.S. PATENT DOCUMENTS

| | | | |
|---|---|---|---|
| 4,441,901 | A | 4/1984 | Endoh |
| 4,716,957 | A | 1/1988 | Thompson et al. |
| 4,761,964 | A | 8/1988 | Pacheco |
| 4,805,689 | A | 2/1989 | Inada et al. |
| 4,921,163 | A | 5/1990 | Viessmann |
| 5,249,436 | A | 10/1993 | Hemsath |
| 5,357,781 | A | 10/1994 | Tikijian |
| 5,509,274 | A | 4/1996 | Lackstrom |
| 5,515,689 | A | 5/1996 | Atterbury |
| 5,820,262 | A | 10/1998 | Lechner |
| 5,970,721 | A | 10/1999 | Kamimura et al. |
| 6,644,047 | B2 | 11/2003 | Taira et al. |
| 6,655,161 | B1 | 12/2003 | Koo |
| 6,701,722 | B1 | 3/2004 | Seo et al. |
| 6,772,598 | B1 | 8/2004 | Rinehart |
| 6,791,088 | B1 | 9/2004 | Williams, II et al. |
| 6,868,678 | B2 | 3/2005 | Mei et al. |
| 6,973,794 | B2 | 12/2005 | Street et al. |
| 7,197,914 | B2 | 4/2007 | Maresca, Jr. et al. |
| 7,814,757 | B2 | 10/2010 | Zima et al. |
| 7,849,700 | B2 | 12/2010 | Seefeldt |
| 8,215,121 | B2 | 7/2012 | Yoshimi et al. |
| 8,280,557 | B2 | 10/2012 | Kawano et al. |
| 8,899,056 | B2 | 12/2014 | Kawano et al. |
| 8,899,099 | B2 | 12/2014 | Grosse Bley et al. |
| 8,924,026 | B2 | 12/2014 | Federspiel et al. |
| 9,222,711 | B2 | 12/2015 | Ochiai et al. |
| 9,239,183 | B2 | 1/2016 | Amick |
| 9,353,979 | B2 | 5/2016 | Morimoto et al. |
| 9,459,032 | B2 | 10/2016 | Nishimura et al. |
| 9,625,195 | B2 | 4/2017 | Hiraki et al. |
| 9,739,513 | B2 | 8/2017 | Ochiai et al. |
| 9,915,450 | B2 | 3/2018 | Seggerman |
| 9,933,205 | B2 | 4/2018 | Hatomura et al. |
| 9,970,665 | B2 | 5/2018 | Bush et al. |
| 10,047,990 | B2 | 8/2018 | Marshall et al. |
| 10,113,763 | B2 | 10/2018 | Ochiai et al. |
| 10,354,332 | B2 | 7/2019 | Trainor et al. |
| 10,514,176 | B2 | 12/2019 | Weinert |
| 10,533,764 | B2 | 1/2020 | Yamada et al. |
| 10,569,620 | B2 | 2/2020 | Vehr et al. |
| 10,571,171 | B2 | 2/2020 | Gariety et al. |
| 10,712,061 | B2 | 7/2020 | Tashiro et al. |
| 10,941,965 | B2 | 3/2021 | Diemer Lopes |
| 2005/0263394 | A1 | 12/2005 | Lewis et al. |
| 2006/0162351 | A1* | 7/2006 | Yahia ..... B60H 1/3208 62/129 |
| 2012/0318011 | A1* | 12/2012 | Ochiai ..... F25B 49/005 62/127 |
| 2016/0178229 | A1 | 6/2016 | Chen et al. |
| 2018/0094844 | A1 | 4/2018 | Suzuki |
| 2018/0347896 | A1 | 12/2018 | Eddy et al. |
| 2019/0056133 | A1 | 2/2019 | Green et al. |
| 2019/0170599 | A1 | 6/2019 | Kester |
| 2019/0170603 | A1 | 6/2019 | Gupte et al. |
| 2019/0170604 | A1 | 6/2019 | Kester |
| 2019/0226705 | A1 | 7/2019 | Sakae et al. |
| 2019/0242632 | A1 | 8/2019 | Sakae et al. |
| 2019/0301780 | A1 | 10/2019 | Schmidt et al. |
| 2019/0331377 | A1 | 10/2019 | Matsuda et al. |
| 2019/0368752 | A1 | 12/2019 | Shiohama et al. |
| 2019/0383526 | A1 | 12/2019 | Nishiyama et al. |
| 2019/0390876 | A1 | 12/2019 | Matsuda et al. |
| 2020/0011580 | A1 | 1/2020 | Matsuda et al. |
| 2020/0033036 | A1 | 1/2020 | Yamada et al. |
| 2020/0049361 | A1 | 2/2020 | Minamida et al. |
| 2020/0124306 | A1* | 4/2020 | Kowald ..... F24F 11/526 |
| 2020/0166257 | A1 | 5/2020 | Wada et al. |

FOREIGN PATENT DOCUMENTS

| | | | |
|---|---|---|---|
| EP | 3287720 | A1 | 2/2018 |
| EP | 3358278 | A1 | 8/2018 |
| EP | 3418655 | A1 | 12/2018 |
| EP | 1970651 | B1 | 7/2019 |
| EP | 3569944 | A1 | 11/2019 |
| EP | 3604981 | A1 | 2/2020 |
| EP | 3614070 | A1 | 2/2020 |
| JP | H11030446 | A | 2/1999 |
| KR | 0158993 | B1 | 1/1999 |
| KR | 20200001931 | A | 1/2020 |
| WO | WO-2017058997 | A1 | 4/2017 |
| WO | WO-2019150462 | A1 | 8/2019 |
| WO | WO-2019171588 | A1 | 9/2019 |

OTHER PUBLICATIONS

Examiner-Initiated Interview Summary regarding U.S. Appl. No. 16/940,843 dated Feb. 5, 2021.

Feng, Shaobin, et al. "Review on Smart Gas Sensing Technology," MDPI Journal on Sensors 2019; Basel Switzerland, Published Aug. 30, 2019.

Islam, Tarikul and Mukjopadhyay, S.C.; "Linearization of the Sensors Characteristics: a review", Exeley International Journal on Smart Sensing and Intelligent Systems Article DOI 10.21307/ijssis-2019-007; Isue 1 vol. 12; 2019.

Nevanda Nano: "Leak Detection Technologies for A2L Refrigerants in HVACR Equipment: Summary of AHRTI Final Report Findings" SM-AN-0012-02.

U.S. Appl. No. 17/077,479, filed Oct. 22, 2020, Brian R. Butler.

U.S. Appl. No. 16/940,843, filed Jul. 28, 2020, Brian R. Butler.

U.S. Appl. No. 16/988,269, filed Aug. 7, 2020, Brian R. Butler.

U.S. Appl. No. 16/921,535, filed Jul. 6, 2020, Andrew M. Welch.

Final Office Action regarding U.S. Appl. No. 16/940,843 dated Mar. 18, 2021.

Applicant-Initiated Interview Summary regarding U.S. Appl. No. 16/940,843 dated May 4, 2021.

International Search Report regarding Application No. PCT/US2021/036209 dated Sep. 24, 2021.

Written Opinion of the ISA regarding Application No. PCT/US2021/036209 dated Sep. 24, 2021.

The Engineering Mindset; "Reversing valve—Heat Pump. How it works, Operation."; Jun. 25, 2017 <https://www.google.com/url?sa=i&url=https%3A%2F%2Fwww.youtube.com%2Fwatch%3Fv%3Dr8n1_6qmsKQ&psig=AOvVaw3KwtomkGwDJVhbQDjFw8OV&ust=1598627750015000&source=images&cd-vfe&ved±0CAIQjRxqFWoTCNDDvs7Wu-sCFQAAAAAdAAAAABAL>.

Daikin Altherma Hybrid Heat Pumps, "Deciding Between A Furnace, Heat Pump Or Hybrid: Know What Matters"; Sep. 29, 2021; https://www.daikin.eu/en_us/product-group/hybrid-heat-pump.html.

International Search Report regarding Application No. PCT/US2021/049260 dated Dec. 17, 2021.

Written Opinion of the ISA regarding Application No. PCT/US2021/049260 dated Dec. 17, 2021.

* cited by examiner

REFRIGERATION LEAK DETECTION

CROSS-REFERENCE TO RELATED APPLICATIONS

This application claims the benefit of U.S. Provisional Application No. 63/036,193, filed on Jun. 8, 2020. The entire disclosure of the application referenced above is incorporated herein by reference.

FIELD

The present disclosure relates to a refrigeration system and more particularly, to a leak detection and isolation arrangement for a refrigeration system.

BACKGROUND

This section provides background information related to the present disclosure which is not necessarily prior art.

Refrigeration and air conditioning applications are under increased regulatory pressure to reduce the global warming potential of the refrigerants they use. In order to use lower global warming potential refrigerants, the flammability of the refrigerants may increase.

Several refrigerants have been developed that are considered low global warming potential options, and they have an ASHRAE (American Society of Heating, Refrigerating and Air-Conditioning Engineers) classification as A2L, meaning mildly flammable. The UL (Underwriters Laboratory) 60335-2-40 standard, and similar standards, specifies a predetermined (M1) level for A2L refrigerants and indicates that A2L refrigerant charge levels below the predetermined level do not require leak detection and mitigation.

SUMMARY

This section provides a general summary of the disclosure and is not a comprehensive disclosure of its full scope or all of its features.

The present disclosure is directed to a system configuration and control methodologies for maintaining levels of A2L refrigerant inside of a building, or any isolated section of the system or fixture within the system, below the predetermined level specified for that A2L refrigerant. Although the present disclosure provides the example of A2L refrigerants, the present disclosure is also applicable to other types of refrigerants.

Residential and commercial heating ventilation and air conditioning (HVAC) systems may include isolation valves placed in refrigerant lines such that in the event of a leak, one or more of the isolation valves would automatically be closed and the amount of refrigerant that would be held within any specific sections between isolation valves inside the building would be below the predetermined level (M1). In some applications, leak sensors may be placed around the system so that in the event of a leak, the isolation valves would be forced closed as a form of mitigation.

In larger refrigeration systems, such as refrigeration systems of supermarkets, the refrigerant charge can be very high, in the hundreds of pounds or greater. By using the leak sensors and isolation valves, in the event of a leak, the isolation valves could close off the section where the leak was detected. This would minimize the amount that could leak, as well as allow the rest of the system to continue operating. This could be a huge advantage in meeting one or more regulatory requirements and/or lowering overall leak rates. In residential or commercial building configurations with an air conditioning (AC) and/or heat pump system using an A2L refrigerant, a leak detection, control, and mitigation system may be required where the system is charged above the M1 charge level. Once a refrigerant leak is detected, a control module may activate a reversing valve and a sequence of isolation valves in concert with the compressor to pump down the refrigerant and isolate the refrigerant outside of the building.

In a configuration for AC only systems, a control module closes the isolation valves following each system cycle, isolating a majority of refrigerant outside of the building, with the amount of refrigerant charge inside the building is held at levels below the predetermined level (M1). This may eliminate the need for A2L leak detection and mitigation by preventing the quantity of refrigerant indoors from exceeding the predetermined level (M1).

In a configuration for AC only systems, various sensors (e.g., temperature, pressure, etc.) may be added to the system. The sensors provide measurements from which a control module can determine the amount of charge inside the building and a total charge within the system. The control module can also track any loss of charge, which may be indicative of a leak. With the added controls, more sophisticated control is possible. Based on data from the additional temperature and pressure sensors, in the case of a refrigerant leak the control module may execute a pump-down sequence that removes a majority of refrigerant from the part of the system inside the building and closes the valves, securing the majority of refrigerant in the part of the system outside of the building. This may result in less than the predetermined level (M1) of the refrigerant being within the building.

In a feature, a vapor compression system includes: a refrigeration cycle including a compressor and a condenser, wherein at least the condenser is disposed outdoors, and indoor components including an expansion valve and an evaporator; a first isolation valve is disposed in the refrigeration cycle between the evaporator and the compressor; a second isolation valve is disposed in the refrigeration cycle between the condenser and the expansion valve wherein the first and second isolation valves can be operated closed to isolate the indoor components from an outdoor section of the refrigeration cycle; and a control module configured to control operation of the first and second isolation valves and maintain a refrigerant quantity within the indoor components below an M1 level.

In a feature, a vapor compression system includes: a refrigeration cycle including a compressor and a condenser, wherein at least the condenser is disposed outdoors, and indoor components including an expansion valve and an evaporator; a first isolation valve is disposed in the refrigeration cycle between the evaporator and the compressor; a second isolation valve is disposed in the refrigeration cycle between the condenser and the expansion valve wherein the first and second isolation valves can be operated closed to isolate the indoor components from the condenser; and a control module configured to sequence opening and closing the first and second isolation valves and operate the compressor to pump out refrigerant from the indoor components to an outdoor section of the refrigeration cycle, wherein the refrigeration cycle is free from an accumulator.

In further features, the control module is configured to perform the pump out by a predetermined timing delay of the first isolation valve, where the first isolation valve is actuated closed in response to suction pressure or temperature.

In further features, the first isolation valve is a check valve.

In further features, the sequencing of the first and second isolation valves ensures that the refrigerant in the indoor components during shut down does not exceed a predetermined quantity.

In a feature, a vapor compression system includes: a refrigeration cycle including a compressor and a condenser wherein at least the condenser is an outdoor component and indoor components including an expansion valve and an evaporator; a first isolation valve is disposed in the refrigeration cycle between the evaporator and the compressor; a second isolation valve is disposed in the refrigeration cycle between the condenser and the expansion valve wherein the first and second isolation valves can be operated closed to isolate the indoor components from the outdoor components; and a control module configured to control operation of the compressor, to open and close the first and second isolation valves, to perform indoor and outdoor charge calculations based on at least one of pressure and temperature, and to control operation of the first and second isolation valves based on the indoor and outdoor charge calculations.

In further features, the control module is configured to close the first and second isolation valves when the system is not operating.

In further features, the control module is configured to close the first and second isolation valves and stop the compressor when a charge calculation indicates a leak in the system.

In further features, the control module is configured to turn off the compressor if a compressor suction pressure drops below a predetermined value.

In further features, an indoor fan is disposed in proximity to the evaporator, wherein the control module is configured to operate the indoor fan when the charge calculation indicates a leak in the system.

In further features, in the event of a leak, the control module is configured to operate the indoor fan for a predetermined length of time after the compressor is tuned off.

In further features, the control module is configured to open and close the first and second isolation valves independently.

In further features, when a charge calculation indicates a leak in the system, the control module is configured to at least one of generate a visual indicator, generate an audible indicator, and transmit an indicator to an external device.

In a feature, a vapor compression system, includes: a refrigeration cycle including a compressor and a condenser wherein at least the condenser is an outdoor component and indoor components including an expansion valve and an evaporator; a first pressure sensor and a first temperature sensor disposed upstream of the compressor; a second pressure sensor and a second temperature sensor disposed upstream of the expansion valve; an indoor fan disposed in proximity to the evaporator; and a control module configured to control operation of the compressor and the indoor fan, wherein the control module is configured to calculate an indoor charge amount and an outdoor charge amount based upon measurements from the first and second pressure sensors and the first and second temperature sensors and determine whether a refrigerant leak based upon the calculated indoor and outdoor charge amounts, wherein the control module is configured to operate the indoor fan when a refrigerant leak is detected.

In further features, the control module is configured to operate the indoor fan for a predetermined period.

In further features, the control module is configured to inhibit operation of the compressor when the calculation of charge indicates a leak.

In a feature, a refrigeration system, includes: a refrigeration cycle having outdoor components including at least one compressor and a condenser and indoor components including a plurality of expansion valves and a plurality of evaporators; a plurality of refrigerant leak sensors each disposed adjacent to respective ones of the plurality of evaporators; a plurality of first isolation valves each disposed upstream of a respective one of the plurality of evaporators; and a plurality of second isolation valves each disposed downstream of a respective one of the plurality of evaporators; and a control module configured to receive signals from the plurality of refrigerant leak sensors and to close a respective one of the plurality of first isolation valves and a respective one of the plurality of second isolation valves associated with the one of the plurality of evaporators where a refrigerant leak sensor detected a leak, thereby isolating the one of the plurality of evaporators from the remainder of the system.

In further features, the first and second isolation valves are selected from sealing ball valves, solenoid valves, electronic expansion valves, check valves, needle valves, butterfly valves, globe valves, vertical slide valves, choke valves, knife valves, pinch valves, plug valves, gate valves and diaphragm valves.

In further features, the control module is configured to open and close the plurality of first and second isolation valves independently.

In further features, when the refrigerant leak sensor indicates a leak in the system, the control module is configured to at least one of generate a visual indication, an audible indication, and communicate with an external device.

In a feature, a refrigeration system includes: a refrigeration cycle having outdoor components including at least one compressor and a condenser and indoor components including a plurality of electrical expansion valves and a plurality of evaporators; a plurality of refrigerant leak sensors each disposed adjacent to respective ones of the plurality of evaporators; a plurality of isolation valves each disposed downstream of a respective one of the plurality of evaporators; and a control module configured to receive signals from the plurality of refrigerant leak sensors and to close a respective one of the plurality of electrical expansion valves and a respective one of the plurality of isolation valves associated with the one of the plurality of evaporators when a refrigerant leak sensor detected a leak, thereby isolating the one of the plurality of evaporators from the remainder of the system.

In further features, the plurality of isolation valves are selected from sealing ball valves, solenoid valves, electronic expansion valves, check valves, needle valves, butterfly valves, globe valves, vertical slide valves, choke valves, knife valves, pinch valves, plug valves, gate valves and diaphragm valves.

In further features, the control module is configured to open and close the plurality of electrical expansion valves and the plurality of isolation valves independently.

In further features, when a refrigerant leak sensor indicates a leak in the system, the control module is configured to at least one of generate a visual indicator, generate an audible indicator, and communicate an indicator to an external device.

In a feature, a heating, ventilation, and air conditioning (HVAC) system, includes: a refrigeration cycle including a compressor and a condenser disposed outdoors relative to a building and an expansion valve and an evaporator disposed indoors relative to the building; a first isolation valve is disposed indoors in the refrigeration cycle between the evaporator and the compressor; a second isolation valve is disposed outdoors in the refrigeration cycle between the condenser and the expansion valve; a first temperature sensor disposed between the second isolation valve and the expansion valve and a second temperature sensor disposed between the expansion valve and the evaporator; and a control module configured to diagnose the presence of a leak through the expansion valve based on measurements from the first and second temperature sensors and to control a state of the first and second isolation valves and operation of the compressor.

In a feature, an HVAC system includes: a refrigeration cycle including a compressor and a condenser disposed outdoors relative to a building and an expansion valve and an evaporator disposed indoors relative to the building; a first isolation valve is disposed indoors in the refrigeration cycle between the evaporator and the compressor; a second isolation valve is disposed outdoors in the refrigeration cycle between the condenser and the expansion valve; a first pressure sensor disposed between the second isolation valve and the expansion valve and a second pressure sensor disposed between the expansion valve and the evaporator; and a control module configured to diagnose a leak through the expansion valve based on measurements from the first and second pressure sensors and to control a state of the first and second isolation valves and operation of the compressor.

In a feature, an HVAC system includes: a refrigeration cycle including a compressor and a condenser disposed outdoors relative to a building and an expansion valve and an evaporator disposed indoors relative to the building; a first isolation valve is disposed indoors in the refrigeration cycle between the evaporator and the compressor; a second isolation valve is disposed outdoors in the refrigeration cycle between the evaporator and the compressor; a third isolation valve is disposed indoors in the refrigeration cycle between the condenser and the expansion valve; a fourth isolation valve is disposed outdoors in the refrigeration cycle between the condenser and the expansion valve; a first temperature sensor disposed up stream of the first isolation valve; a second temperature sensor disposed between the first isolation valve and the second isolation valve; a third temperature sensor disposed downstream of the second isolation valve; a fourth temperature sensor disposed up stream of the fourth isolation valve; a fifth temperature sensor disposed between the fourth isolation valve and the third isolation valve; a sixth temperature sensor disposed downstream of the third isolation valve; and a control module configured to control a state of the first, second, third and fourth isolation valves and operation of the compressor, wherein the control module is configured to diagnose leaks when the first, second, third, and fourth isolation valves are closed based on measurements from the first, second, third, fourth, fifth, and sixth temperature sensors.

In a feature, a vapor compression system includes: a refrigeration cycle including a compressor and a condenser, wherein at least the condenser is an outdoor component and indoor components including an expansion valve and an evaporator; a first isolation valve is disposed in the refrigeration cycle between the evaporator and the compressor; and a second isolation valve is disposed in the refrigeration cycle between the condenser and the expansion valve wherein the first and second isolation valves can be operated closed to isolate the indoor components from an outdoor section of the refrigeration cycle; and a control module configured to calculate a refrigerant charge in an isolated indoor region of the refrigeration cycle and to control the first and second isolation valves and maintain the refrigerant charge in the isolated region below an predetermined charge level.

In further features, the control module is configured to calculate the refrigerant charge in the isolated indoor region based on liquid temperature, suction temperature, and suction pressure.

In further features, the control module is configured to calculate the refrigerant charge in the isolated indoor region based on liquid temperature, suction temperature, and evaporator temperature.

In further features, the control module is configured to calculate the refrigerant charge using a relationship between specific volume to enthalpy in refrigerant phase regions.

In further features, the control module calculates the refrigerant charge based on a predetermined ratio between log mean temperature difference and enthalpy change between measured and predetermined design values and a predetermined ratio between the overall heat transfer coefficient of liquid, vapor, and 2-phase heat transfer.

In a feature, a vapor compression system includes: a refrigeration cycle including a compressor and a condenser, wherein at least the condenser is an outdoor component, and indoor components including an expansion valve and an evaporator; and a control module configured to calculate the indoor refrigerant charge of the system and the outdoor refrigerant charge of the system, to determine a total charge of the system based on the indoor and outdoor refrigerant charges, and to diagnose whether a leak is present based on the total charge of the system.

In further features, the control module is configured to calculate the indoor refrigerant charge based on liquid temperature, suction temperature, and suction pressure.

In further features, the control module is configured to calculate the indoor refrigerant charge based on liquid temperature, suction temperature, and evaporating temperature.

In further features, the control module is configured to calculate the outdoor refrigerant charge based on liquid temperature, liquid pressure, and suction temperature.

In further features, the control module is configured to calculate the outdoor refrigerant charge based on liquid temperature, suction temperature, and condensing temperature.

In further features, the control module is configured to calculate the indoor and outdoor refrigerant charges based on a relationship between specific volume to enthalpy in refrigerant phase regions.

In a feature, a refrigerant control system includes: a charge module configured to determine an amount of refrigerant that is present within a first portion of a refrigeration system within a building; and an isolation module configured to selectively open and close an isolation valve of the refrigeration system and to, via the isolation valve, maintain the amount of refrigerant within the first portion within the building below a predetermined amount of the refrigerant.

In further features, the refrigerant is classified as being flammable under at least one standard.

In further features, the predetermined amount of the refrigerant is one of (a) specified in and (b) calculated according to at least one standard.

In further features, the isolation valve is located between an output of a first heat exchanger located outside of the building of the refrigeration system and an input of second heat exchanger located within the building of the refrigeration system.

In further features, the isolation module is configured to at least partially close the isolation valve as the amount of refrigerant within the building increases toward the predetermined amount of the refrigerant.

In further features, the isolation module is configured to at least partially open the isolation valve as the amount of refrigerant within the building decreases away from the predetermined amount of the refrigerant.

In further features, the isolation valve is located between an output of a first heat exchanger located within the building and an input of a compressor of the refrigeration system.

In further features, the isolation module is configured to at least partially close the isolation valve as the amount of refrigerant within the building decreases away from the predetermined amount of the refrigerant.

In further features, the charge module is configured to determine the amount of refrigerant within the first portion of the refrigeration system within the building based on at least one of a temperature within the refrigeration system and a pressure within the refrigeration system.

In further features, the charge module is configured to determine the amount of refrigerant within the first portion of the refrigeration system within the building further based on a first volume of a first heat exchanger located within the building and a second volume of refrigerant lines of the refrigeration system.

In further features, the charge module is configured to determine the first and second volumes based on at least one temperature, at least one pressure, and a volumetric flow rate of a compressor.

In further features, the charge module is configured to determine the first and second volumes based on a ratio of: (a) a rate of change of the amount of refrigerant within the first portion of the refrigeration system within the building to (b) a rate of change of density of the refrigerant within the first portion of the refrigeration system within the building.

In further features, the refrigeration system does not include a refrigerant leak sensor located within the building.

In further features, the isolation module is configured to selectively open and close two isolation valves of the refrigeration system and to, via the two isolation valves, maintain the amount of refrigerant within the first portion within the building below the predetermined amount of the refrigerant.

In further features, the isolation module is configured to selectively close the two isolation valves in response to a command to turn off a compressor of the refrigeration system.

In further features, the isolation module is configured to open the two isolation valves in response to a command to turn on a compressor of the refrigeration system.

In a feature, a refrigerant control method includes: determining an amount of refrigerant that is present within a first portion of a refrigeration system within a building; selectively opening and closing an isolation valve of the refrigeration system; and via the isolation valve, maintaining the amount of refrigerant within the first portion within the building below a predetermined amount of the refrigerant.

In further features, the refrigerant is classified as being flammable under at least one standard.

In further features, the predetermined amount of the refrigerant is one of (a) specified in and (b) calculated according to at least one standard.

In further features, the refrigeration system does not include a refrigerant leak sensor located within the building.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1C:
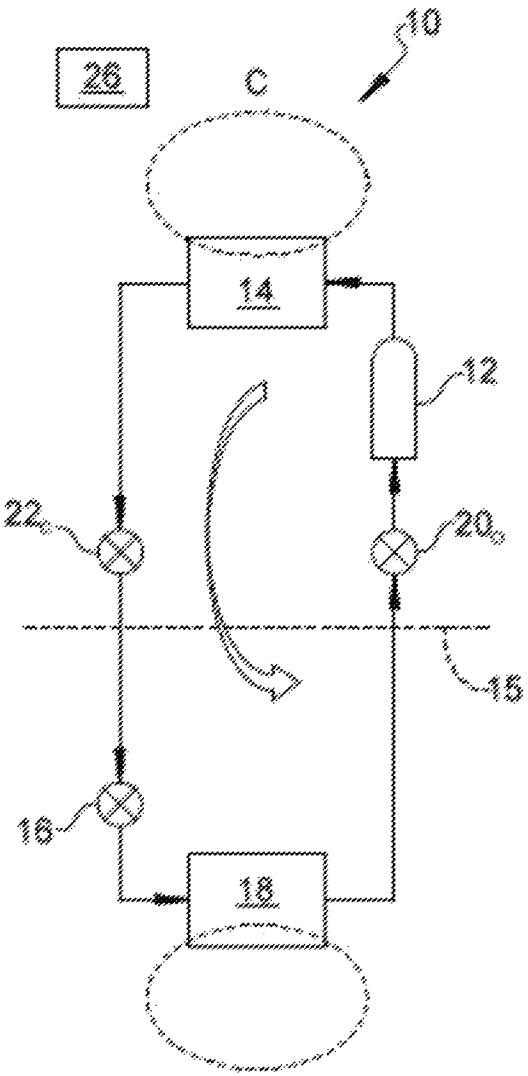
FIGS. 1A-1C are schematic views of a residential split air conditioning system.

Example embodiments will now be described more fully with reference to the accompanying drawings. Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1B:
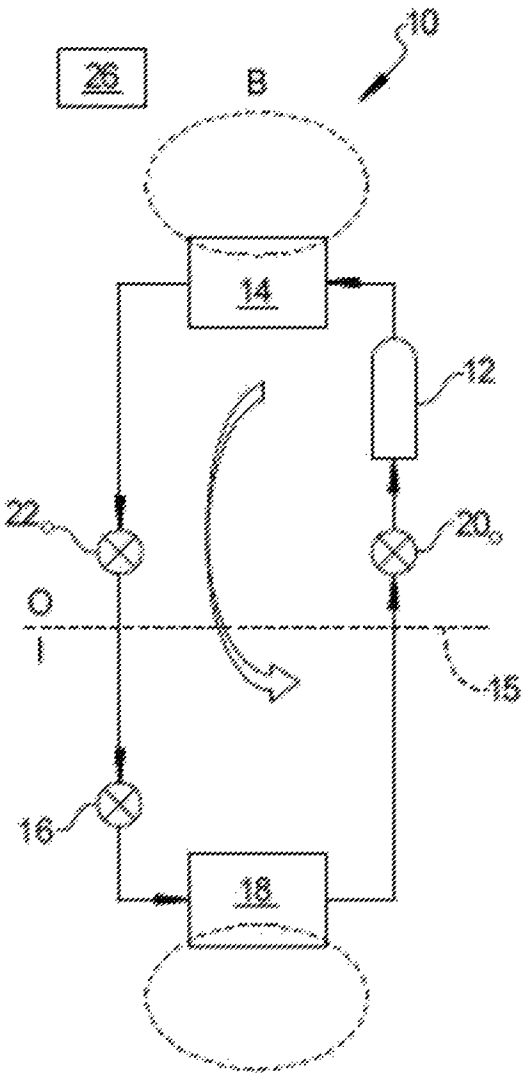
Figure 1A:
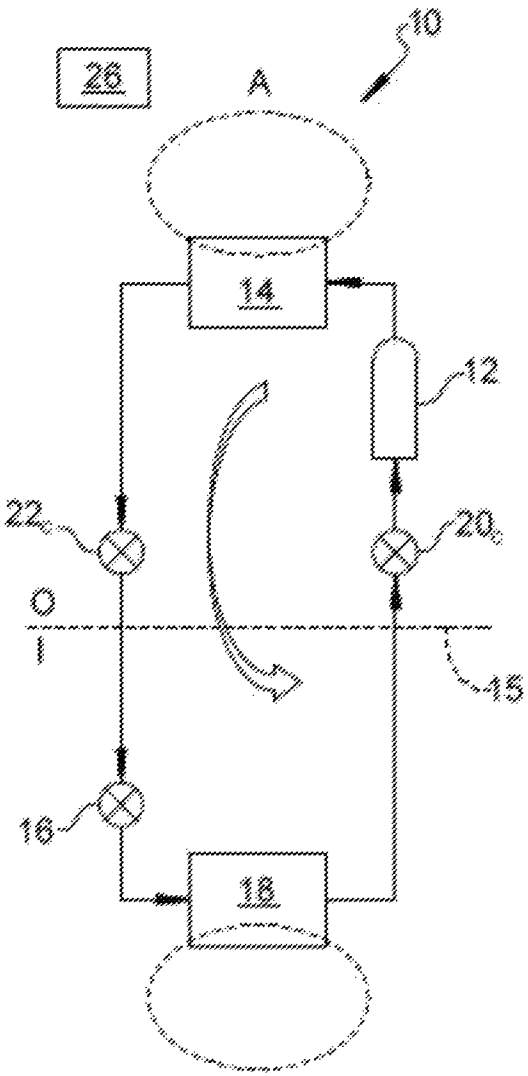

With reference to FIGS. 1A-C, a split air conditioning (AC) system 10 is shown including a compressor 12 and a condenser 14 disposed outside of a building 15 (i.e., outside) that is cooled using the AC system 10. The AC system 10 includes an expansion valve 16 and an evaporator 18 disposed inside the building 15 (i.e., indoors) that is cooled using the AC system 10.

A first isolation valve 20 is disposed outside of the building 15 and between the evaporator 18 and the compressor 12. A second isolation valve 22 is disposed outside of the building 15 and between the condenser 14 and the expansion valve 16. Refrigerant lines connect are connected between the components of the AC system 10. For example, a refrigerant line is connected between the compressor 12 and the condenser 14, a refrigerant line is connected between the condenser 14 and the second isolation valve 22, a refrigerant line is connected between the second isolation valve 22 and the expansion valve 16, a refrigerant line is connected between the expansion valve 18 and the evaporator 18, a refrigerant line is connected between the evaporator 18 and the first isolation valve 20, and a refrigerant line is connected between the first isolation valve 20 and the compressor 12.

In FIG. 1A, the AC system 10 is shown in an "OFF" condition with the compressor 12 OFF and the first and second isolation valves 20*c*, 22*c* CLOSED. FIG. 1B shows the AC system 10 in a normal operating mode with the compressor "ON" and the first and second isolation valves 200, 220 OPEN. At shutdown, as shown in FIG. 1C, a control module (discussed further below) may close the second isolation valve 22*c*, maintain the first isolation valve 200 open, and maintain the compressor 12 on for a predetermined period. This may pull down refrigerant from within the indoor section of the AC system 10 and trap the refrigerant within the outdoor section of the air conditioning system 10. After the predetermined period has expired, the control module may close the first isolation valve 200 and turn the compressor 12 off, as shown in FIG. 1A. This may isolate the indoor section I of the AC system 10 from the outdoor section O. The effect of the pump out of refrigerant from the indoor section I to the outdoor section O reduces an amount (e.g., a mass or a weight) of refrigerant within in the indoor section I to less than a predetermined amount a minimal level preferably below the M1 charge level for the A2L refrigerant.

The isolation valves 20, 22 may be positive sealing and controlled by a control module. The control module also controls operation (e.g., on or off) and may control speed of the compressor 12. The control module selectively controls the isolation valves 20, 22 according to an operational state and requirements to selectively divide the AC system 10 including the piping (refrigerant lines) and components of the system into zones. In various implementations, the isolation valve 20 can be integrated with the compressor 12, for example, as a discharge check valve or a suction check valve. The isolation valves 20, 22 can be sealing ball valves, solenoid valves, electronic expansion valves, check valves, needle valves, butterfly valves, globe valves, vertical slide valves, choke valves, knife valves, pinch valves, plug valves, gate valves, diaphragm valves, or another suitable type of actuated valve.

During the pump out operation, refrigerant is moved at the end of a compressor operational cycle to the isolated outdoor zones of the system. This lowers the amount of refrigerant that is within the building 15 that could possibly leak within the building 15 when the compressor is non-operational.

The control module can communicate with the compressor 12, one or more fans, the isolation valves 20, 22, and various sensors wirelessly or by wire and do so directly or indirectly. The control module can include one or more modules and can be implemented as part of a control board, furnace board, thermostat, air handler board, contactor, or other form of control system or diagnostic system. The control module can contain power conditioning circuitry to supply power to various components using 24 Volts (V) alternating current (AC), 120V to 240V AC, 5V direct current (DC) power, etc. The control module can include bidirectional communication which can be wired, wireless, or both whereby system debugging, programming, updating, monitoring, parameter value/state transmission etc. can occur. AC systems can more generally be referred to as refrigeration systems.

Figure 2:
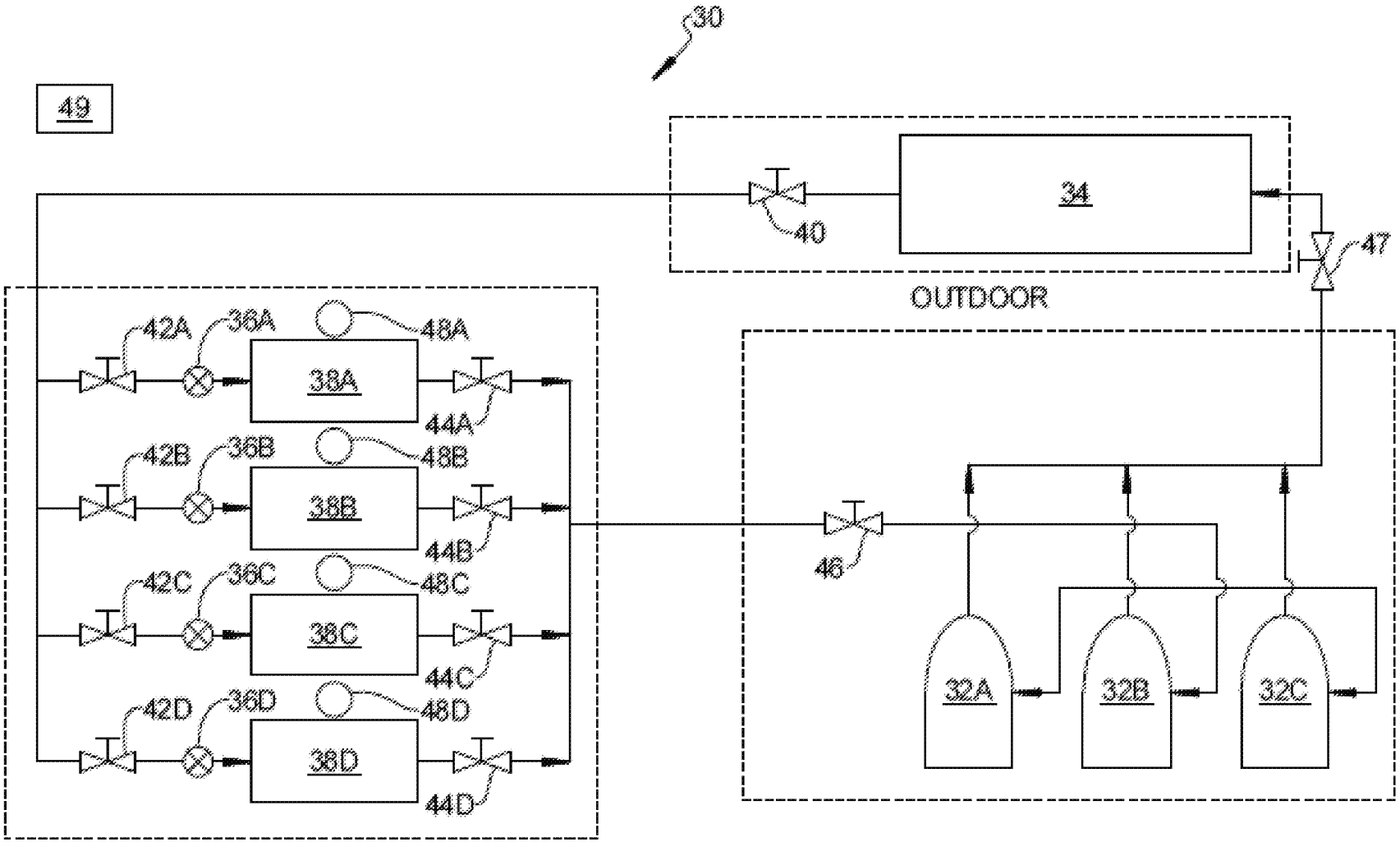
FIG. 2 is a schematic view of a rack refrigeration system.

With reference to FIG. 2 a rack refrigeration system 30 of a building 35 (e.g., a commercial building, such as a supermarket) is shown including a plurality of compressors 32A-C and a condenser 34 disposed outdoors or in a ventilated indoor room in the building 35. A plurality of electronic expansion valves or thermal expansion valves 36A-D (hereinafter "expansion valves 36A-D") and a plurality of evaporators 38A-D are located inside of the building 35 (i.e., inside of or in an indoor side I the building 35).

A first isolation valve 40 is disposed on the outdoor side O of the building 35 (i.e., outdoors) and between the condenser 34 and the plurality of evaporators 38A-D. A plurality of second isolation valves 42A-D may be disposed between the condenser 34 and the expansion valves 36A-D within the indoor section I of the refrigeration system 30. If electronic expansion valves 36A-D are used and are capable of properly sealing, the plurality of second isolation valves 42A-D may be omitted and the expansion valves 36A-D may be used as the isolation valves 42A-D.

A plurality of third isolation valves 44A-D are disposed between the plurality of evaporators 38A-D, respectively, and the compressors 32A-C, such as within the indoor section I. A fourth isolation valve 46 can be disposed outside of the building 35 and upstream of the plurality of compressors 32A-C. While the example of three compressors is provided, a greater or lesser number of compressors may be used. A fifth isolation valve 47 can be disposed between the plurality of compressors 32 and the condenser 34. While the example of one condenser 34 is provided, multiple condensers may be connected in parallel.

A plurality of leak sensors 48A-D can be placed in proximity to each of the plurality of evaporators 38A-D, such as at a midpoint of the evaporators 38A-D, respectively. The evaporators 38A-D may be disposed at the lowest point of the refrigeration system 30 (i.e., lower than the other components of the refrigeration system 30). Because the A2L refrigerant may be heavier than air, the placement of the leak sensors 48A-D in proximity to the evaporators 38A-D may increase a likelihood of detecting the presence of a leak the indoor section I.

The leak sensors 48A-D can be, for example, an infrared leak sensor, an optical leak sensor, a chemical leak sensor, a thermal conductivity leak sensor, an acoustic leak sensor, an ultrasonic leak sensor, or another suitable type of leak sensor. A control module 49 is provided in communication with the isolation valves, compressors 32A-C, and leak sensors 48A-D. If a leak is detected at one of the plurality of evaporators 38A-D, the control module 49 may close the associated isolation valves 42A-D, 44A-D, or electronic expansion valves 36A-D of that one of the evaporators 38A-D. This may isolate the one of the evaporators 38A-D that has the leak so that the remaining evaporators 38A-D of the refrigeration system can continue to function without disruption while preventing the refrigerant from escaping from the refrigeration system.

The control module 49 may close the additional isolation valves 40, 46 to isolate the indoor refrigeration section from the outdoor refrigeration section, such as when the refrigeration system is off or during maintenance.

The plurality of compressors 32A-C can be provided with an oil separator and a liquid receiver can be provided downstream of the condenser 34. Each of the evaporators 38A-D can be associated with a predetermined low temperature (e.g., for frozen food) or a predetermined medium temperature (e.g., refrigerated food) refrigeration compartment.

Figure 3:
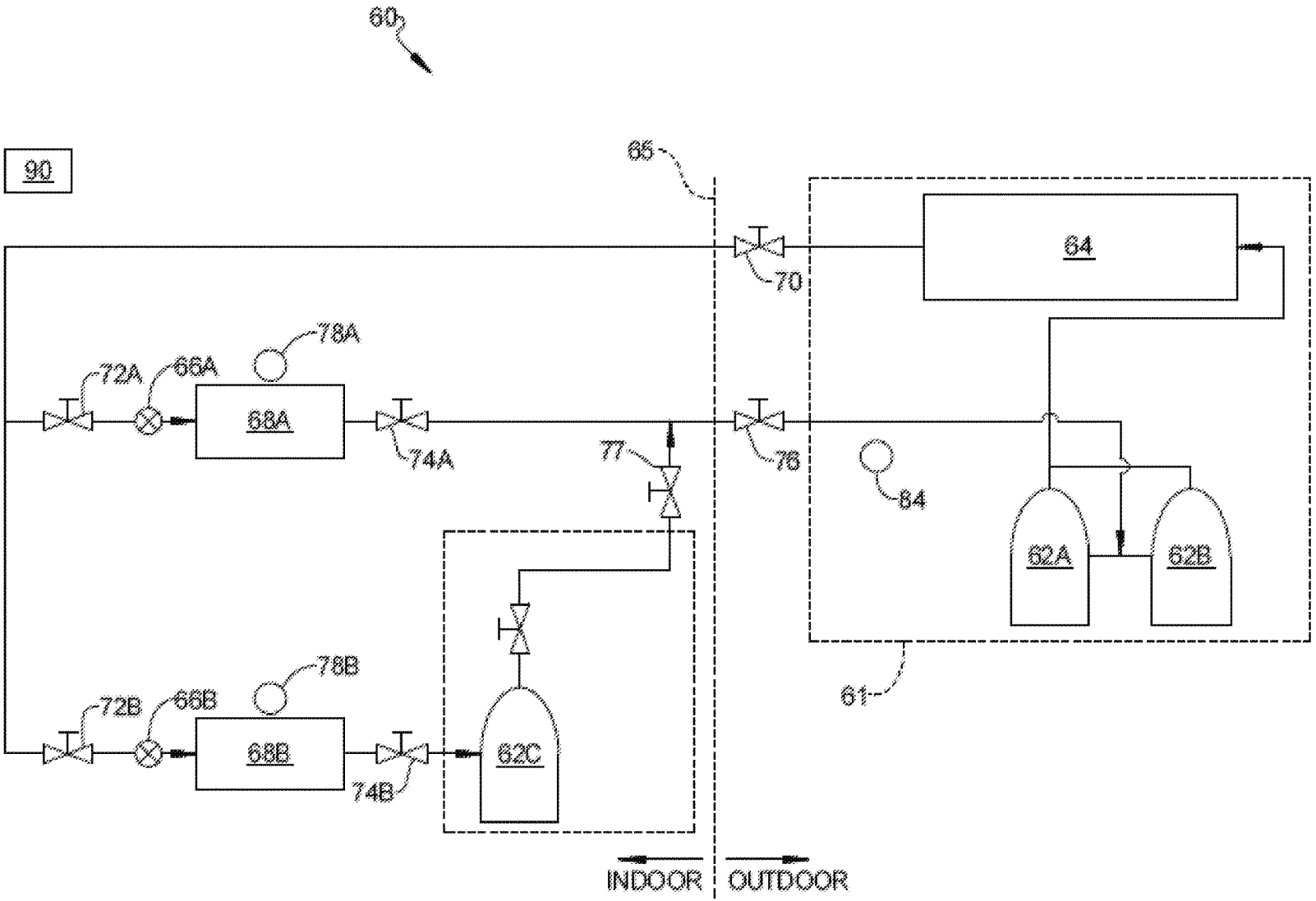
FIG. 3 is a schematic view of a microbooster refrigeration system.

With reference to FIG. 3 a refrigeration system 60 (e.g., a microbooster refrigeration system) is shown including an (e.g., medium temperature) condensing unit 61 including a plurality of outdoor compressors 62A-B and a condenser 64 disposed outside of a building 65 (e.g., a supermarket or another type of commercial building). A plurality of expansion valves 66A-B and a plurality of evaporators 68A-B are disposed inside of the building 65 (i.e., indoors).

An additional compressor unit 62C may be included inside the building 65 in connection with the evaporator 68B. The evaporator 68B may be associated with a low temperature (frozen food) refrigeration compartment, while the evaporator 68A may be associated with a higher (e.g., medium) temperature (e.g., refrigerated food) refrigeration compartment.

A first isolation valve 70 is disposed (e.g., in the outdoor side O of the building 65) between the condenser 64 and the plurality of evaporators 68A-B. A plurality of second isolation valves 72A-B may be disposed between the condenser 64 and the expansion valves 66A-B, such as within the indoor section I of the refrigeration system 60. If electronic expansion valves 66A-B implemented and configured to seal, the plurality of second isolation valves 72A-B may be omitted and the electronic expansion valves 66A-may serve the as isolation valves.

A plurality of third isolation valves 74A-B are disposed downstream of the plurality of evaporators 78A-B and between the evaporators 78A-B, respectively, and the compressors 62A-B. A fourth isolation valve 76 can be implemented up stream of the plurality of compressors 62A-B, such as inside or outside of the building 65. A fifth isolation valve 77 can be disposed between the low temperature compressor(s) 62C and the compressors 62A-B.

A plurality of leak sensors 78A-B can be disposed near the plurality of evaporators 68A-B, respectively. The evaporators 68A-B may be disposed at a lowest point of the refrigeration system 60. Because the L2A refrigerant may be heavier than air, the placement of the leak sensors 78A-B in proximity to the evaporators 68A-B may increase a likelihood of detection of the presence of leaked A2L refrigerant within the indoor environment I.

The leak sensors 78A-B may be infrared leak sensors, optical leak sensors, chemical leak sensors, thermal conductivity leak sensors, acoustic leak sensors, ultrasonic leak sensors, or another suitable type of leak sensor. If a leak is detected at one of the plurality of evaporators 68A-B, a control module may close the associated isolation valves 72A-B, 74A-B or electronic expansion valves 66A-B to isolate the one of the evaporators 68A-B that is determined to be leaking. This may allow the remaining evaporator(s) to continue to function without disruption.

The plurality of outdoor compressors 62A-B can be included with an oil separator, and a liquid receiver can be included downstream of the condenser 64. The evaporator 68A can be associated with a (e.g., medium temperature) refrigeration compartment. The evaporator 68B can be associated with a (e.g., low temperature) refrigeration compartment.

A control module 90 communicates with the isolation valves, compressors, and leak sensors. The control module 90 may control the isolation valves 70, 76, such as to isolate the indoor section I from the outdoor section O of the refrigeration system 60. The isolation valve 74B may be omitted since the isolation valve 77 is downstream of the compressors 62C.

The control module 90 may control the isolation valves 76 and 77 to minimize leak potential depending on the amount of refrigerant trapped in each of the indoor and outdoor sections. An additional outdoor leak sensor 84 may be included, such as to detect refrigerant leakage from the condensing unit 61.

Figure 5A:
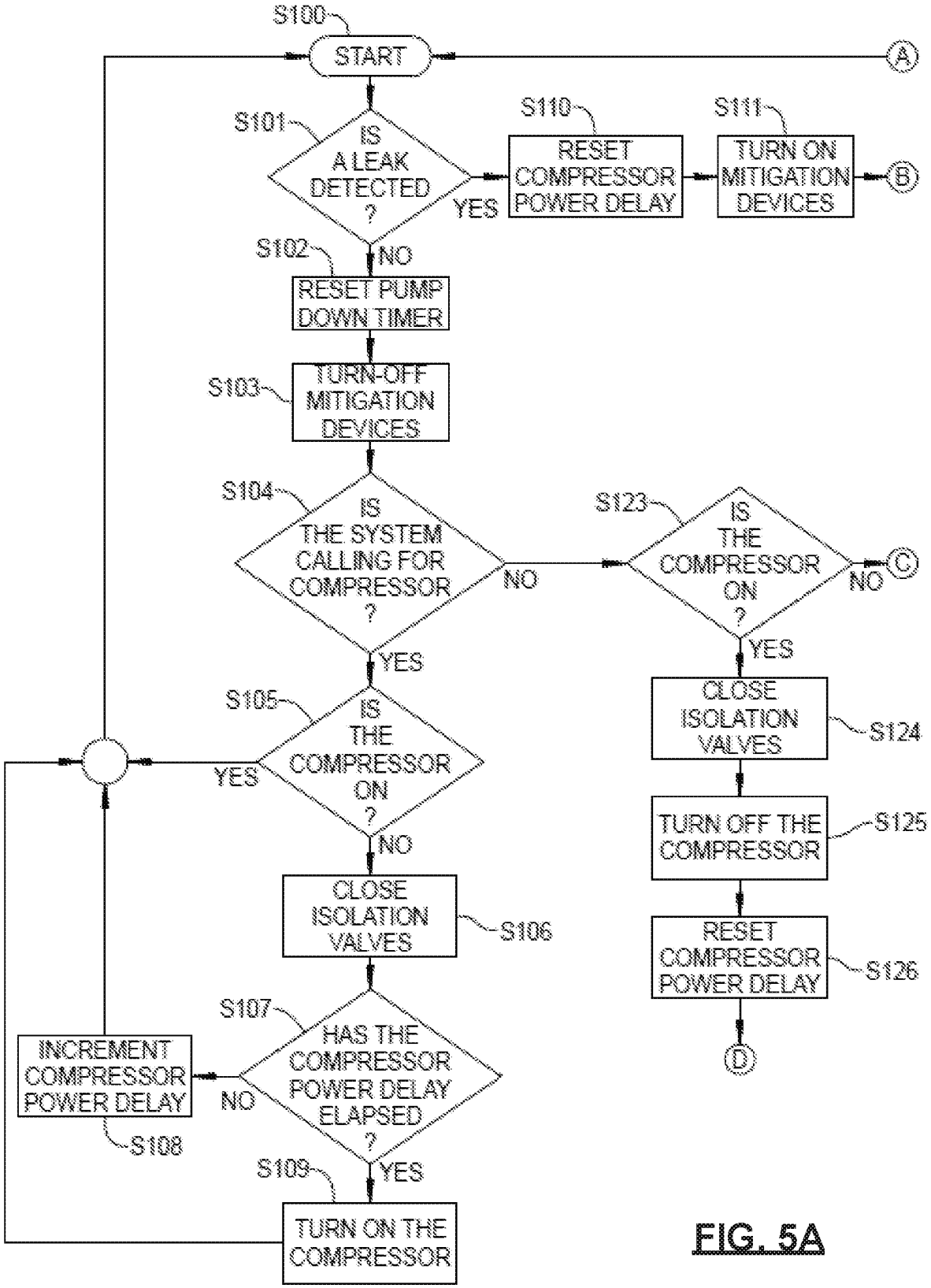
FIGS. 5A-5B are a flowchart depicting an example method of controlling isolation valves and a compressor of a refrigeration or HVAC system.
Figure 5B:
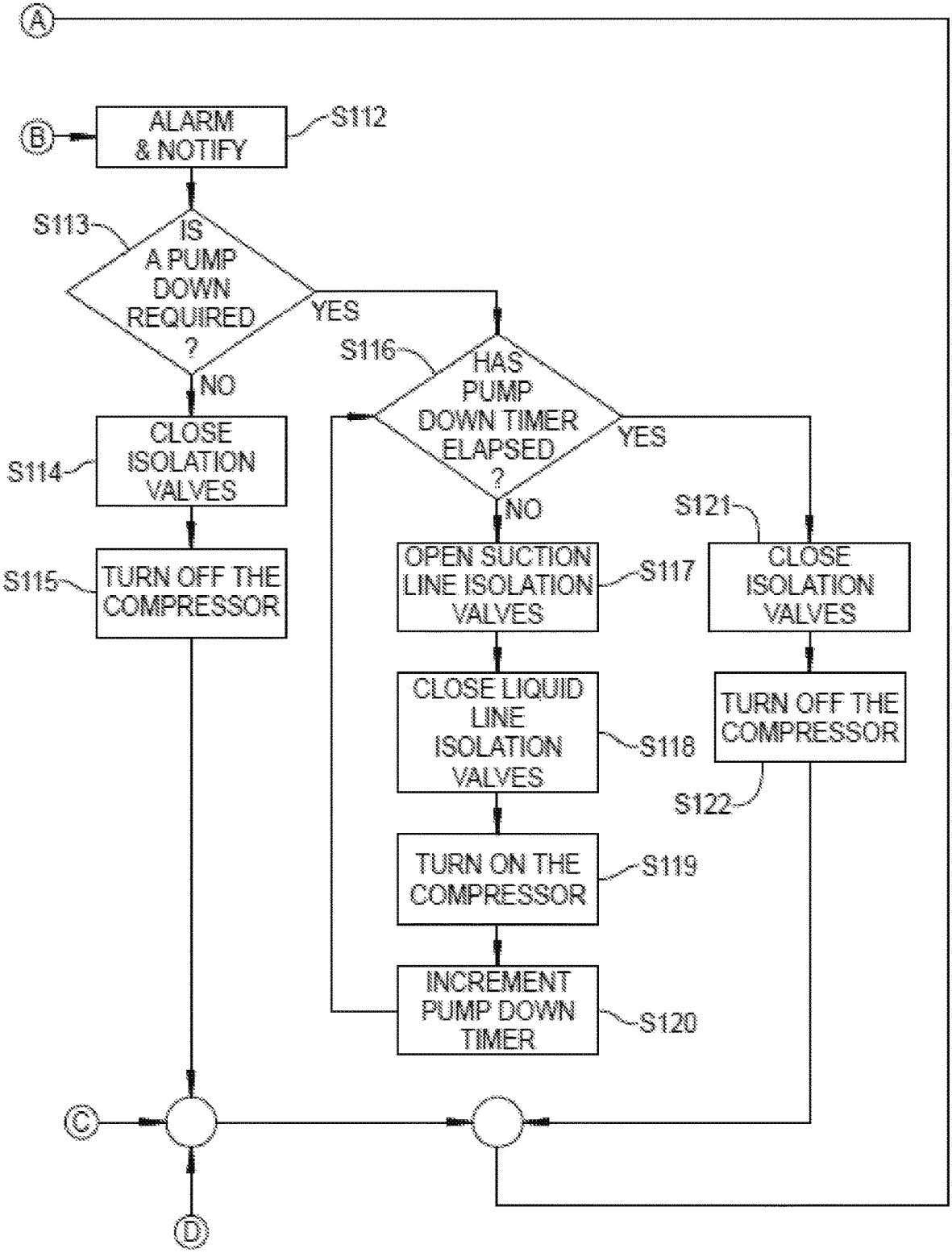

FIGS. 5A-5B are a flowchart depicting an example method of controlling the isolation valve(s) and compressor operation. Control discussed herein may be executed by a control module or one or more submodules of a control module.

At S100, control begins and proceeds with S101 where control determines whether a leak is detected. As discussed herein, a control module may detect a leak based on input from one or more leak sensors, pressure sensors, and/or temperature sensors. For example, a control module may calculate an amount of refrigerant within the system and determine that a leak is present when the amount of refrigerant deceases by at least than a predetermined amount. Other ways to determine whether a leak is present are discussed herein.

If no leak is detected at S101, control continues with S102 where the control module resets a pump down timer. The algorithm proceeds to S103 where the control module turns off mitigation devices. For example, the control module may turn off an indoor fan/blower within the building, such as a blower that blows air across the evaporator(s). While the example of the fan/blower is provided, one or more other devices configured to mitigate a leak may additionally or alternatively be turned off. If a leak is detected as S101, control transfers to 110, which is discussed further below.

At S104, the control module determines whether a call for compressor operation has been received, such as from a thermostat of the building. If S104 is true, control continues with S105. If S104 is false, control transfers to S123, which is discussed further below.

At S105, the control module determines whether the compressor is ON. If the compressor is ON at S105, control returns to S100. If the compressor is OFF at S104, control continues with S106. At S106, the control module opens one, more than one, or all of the isolation valves. At S107, the control module determines whether a predetermined compressor power delay period has elapsed since the compressor was last turned OFF. The control module may determine that the predetermined compressor power delay period has elapsed when a compressor power delay counter is greater than a predetermined value (corresponding to the predetermined compressor delay period). While the example of a counter is provided, a timer may be used and the period of the timer may be compared with the predetermined compressor power delay period. If the predetermined compressor power delay has not elapsed at S107, the control module increments (e.g., by 1) the compressor power delay counter at S108, and control returns to S101. If the predetermined compressor power delay has elapsed at S107, the control module turns on the compressor at S109, and control returns to S100.

As discussed above, if a leak is detected as S101, control continues with S110. At S110, the control module resets the compressor power delay counter (e.g., to zero). While the example of incrementing the counter and resetting the counter to zero are provided, the control module may alternatively decrement the counter (e.g., by 1), reset the counter to the predetermined value, and compare the counter value to zero. At S111, the control module turns the mitigation device(s) ON. For example, the control module may turn on the fan/blower within the building. Control continues with S112 (FIG. 5B).

At S112, the control module generates one or more indicators that a leak is present. For example, the control module may activate a visual indicator (e.g., one or more lights or another type of light emitting device), display a message on a display, etc. The display may be, for example, may be a display of the control module or another device (e.g., the thermostat). Additionally or alternatively, the control module may output an audible indicator via one or more speakers.

At S113, the control module determines whether to pump down the refrigeration system. A predetermined pump down requirement (e.g., a predetermined pump down period) can be a set, for example, based on a predetermined volume of the refrigeration system within the building and set at installation and is greater than zero. Alternatively, the predetermined pump down requirement can be determined by the control module, for example, based on an indoor charge calculation as discussed herein. If at S113 it is determined that no pump down is required, control continues with S114 where the control module closes the isolation valves. The control module turns off the compressor at S115, and control returns to S100.

If the control module determines to pump down the refrigeration system at S113, control continues with S116. At S116, the control module determines whether a predetermined pump down period has elapsed since the determination was made to pump down the refrigeration system. The control module may determine that the predetermined pump down period has elapsed when a pump down timer is greater than the predetermined pump down period. While the example of a timer is provided, a counter may be used and the counter value may be compared with a predetermined value corresponding to the predetermined pump down period. If the predetermined compressor pump down period has not elapsed at S116, control continues with S117. If the predetermined pump down period has elapsed at S116, control transfers to S121, which is discussed further below.

At S117, the control module opens (or maintains open) one or more isolation valves implemented in suction lines (e.g., 20 of FIGS. 1A-1C, 44A-C and/or 46 in FIG. 2, etc.). Isolation valves implemented in suction lines are located between an output of one or more condensers and input of one or more compressors. At S118, the control module closes (or maintains closed) one or more isolation valves implemented in liquid lines (e.g., 22 of FIGS. 1A-1C, 42A-D and/or 40 of FIG. 2, etc.). Isolation valves implemented in liquid lines are located between an output of one or more compressors and an input of one or more evaporators. At S119, the control module turns on the compressor(s). The compressor(s) then draw refrigerant out of the indoor section of the refrigeration system and trap the refrigerant in the outdoor section of the refrigeration system, outside of the building. The control module increments the pump down timer at S120, and control returns to S116.

At S121, when the predetermined pump down period has elapsed, the control module closes the isolation valves (e.g., including those implemented in suction lines). At S122, the control module turns the compressor off. Control returns to S100.

Returning to S104 if the control module determines that a call for operation of the compressor has not been received, control continues with S123. At S123, the control module determines whether the compressor is ON. If S123 is true, control continues with S124. At S124, the control module closes or maintains closed (e.g., all of) the isolation valves. At S125, the control module turns off or maintains off the compressor(s). At S126, the control module resets the compressor delay counter (e.g., to zero), and control returns to S100.

With the pump down operation, the refrigerant inside a potentially occupied space (indoors, within the building) is minimized during compressor non-operational time by use of a compressor pump down along with closure of the liquid side isolation valve(s) before the compressor shut down and closure of the vapor line isolation valve(s) when the compressor(s) is shutdown. The decision process may include an evaluation of early leak indicators to prevent larger leaks or the frequency of operation to indicate the potential for a long off period.

Figure 6:
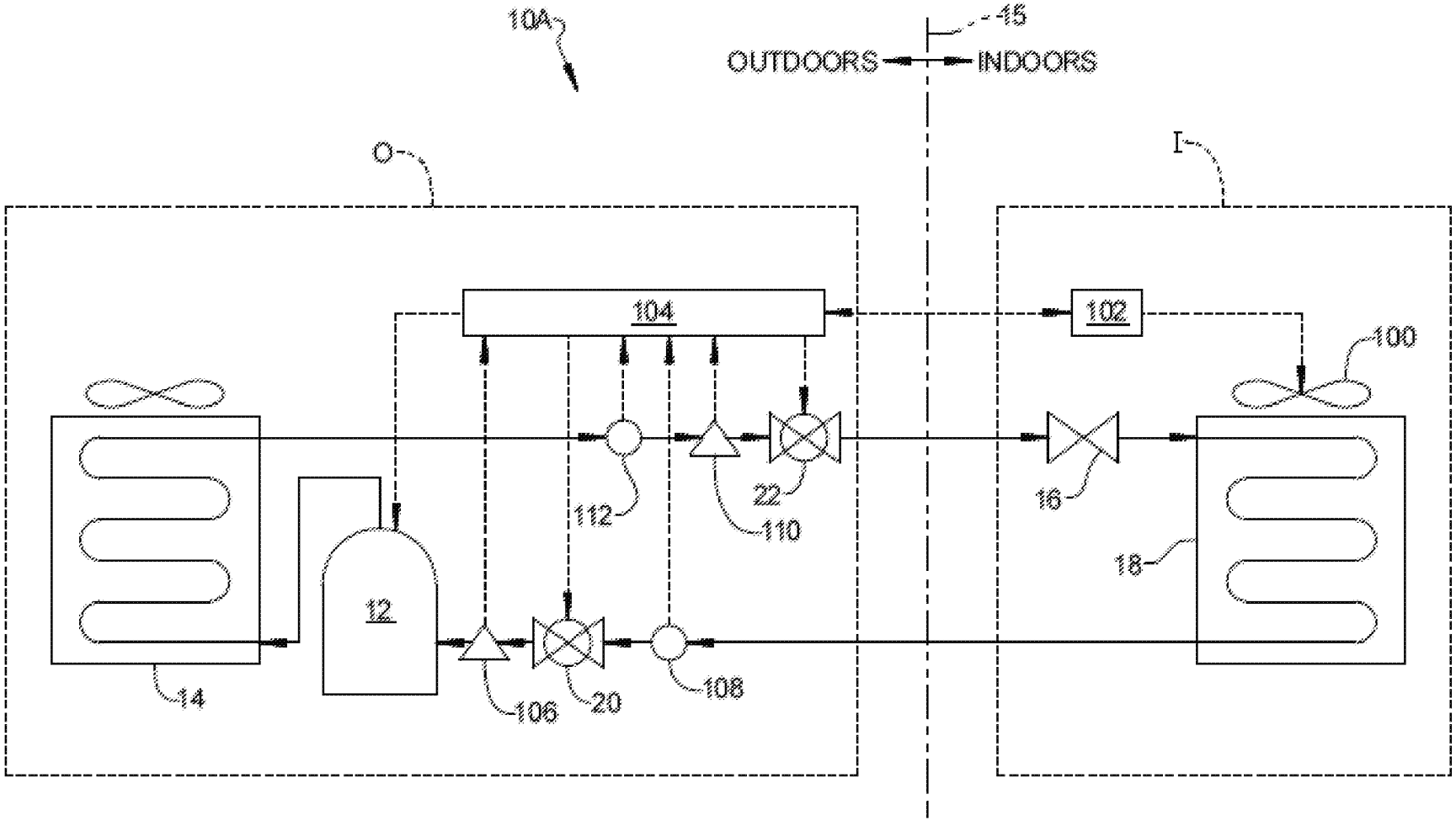
FIG. 6 is a functional block diagram of an example air conditioning system including isolation valves, pressure sensors, and temperature sensors.

With reference to FIG. 6 functional block diagram of an example refrigeration system 10A (e.g., an air conditioning system) is provided. Isolation valves and pressure and temperature sensors are included in FIG. 6.

The system 10A is shown including a compressor 12 and a condenser 14 disposed outside of a building 15 (i.e., outdoors). An expansion valve 16 and an evaporator 18 are disposed inside of the building 15 (i.e., indoors).

A first isolation valve 20 is disposed, for example, outside of the building 15 and is disposed (in a suction line) between the evaporator 18 and the compressor 12. A second isolation valve 22 is disposed, for example, outside of the building 15, and is disposed (in a liquid line) between the condenser 14 and the expansion valve 16.

A fan or blower 100 (a mitigation device) is provided adjacent to the evaporator 18 and is controlled by a first control module 102. A second control module 104 calculates indoor and outdoor refrigerant charge amounts based on measurements from a first temperature sensor 106 and a first pressure sensor 108 disposed between the evaporator 18 and the compressor 12 and a second temperature sensor 110 and a second pressure sensor 112 disposed between the condenser 14 and the expansion valve 16. The amount of indoor and outdoor charge amounts may be calculated while the HVAC system is ON and, more specifically, when the compressor 12 is on. The indoor and outdoor refrigerant charge amounts are amounts (e.g., masses or weights) of the refrigerant within the indoor and outdoor sections of the refrigeration system, respectively. The second control module 104 may calculate the indoor charge amount, for example, using one or more equations or lookup tables that relate the measurements from the temperature and pressure sensors to indoor charge amounts. The second control module 104 may calculate the outdoor charge amount, for example, using one or more equations or lookup tables that relate the measurements from the temperature and pressure sensors to outdoor charge amounts.

The second control module 104 may determine an overall (or total) refrigerant charge amount based on the indoor and outdoor refrigerant charge amounts. The second control module 104 may calculate the overall charge amount, for example, using one or more equations or lookup tables that relate indoor and outdoor charge amounts to overall charge amounts. For example, the second control module 104 may set the overall charge amount based on or equal to the indoor charge amount plus the outdoor charge amount.

If the overall charge amount decreases from a predetermined (e.g., initial amount) of refrigerant by at least a predetermined amount, the second control module 104 may determine that a leak is present. The second control module 104 may determine that no leaks are present when the overall charge amount has not decreased by at least the predetermined amount. The predetermined amount may be calibrated and may be greater than zero.

If a leak is detected, the second control module 104 performs a pump out routine. The second control module 104 closes the second isolation valve 22, opens the first isolation valve 20, and turns the compressor 12 on to pump down refrigerant from the indoor side I to the outdoor side O of the system 10. The second control module 104 later closes the first isolation valve 20 and turns off the compressor to isolate the outdoor section O of the system from the indoor section I of the system, for example, when the predetermined pump down period has elapsed. The second control module 104 prompts the first control module 102 to turn ON the fan 100 when a leak is detected. The second control module 104 may also prompt the first control module 102 or itself turn on one or more other mitigation devices when a leak is detected. This may help dissipate or reduce any leaked refrigerant.

The second control module 104 may determine whether a leak is present, for example, by detecting a pressure decrease in at least one of the outdoor section and the indoor section of the refrigeration system. When the isolation valves 20, 22, the compressor 12, or the expansion device 16 is/are used to control the refrigerant charge within the indoor section inside of a potentially occupied space the control module 104 may activate the fan 100 to dilute a refrigerant leak when a leak is detected.

Figure 4:
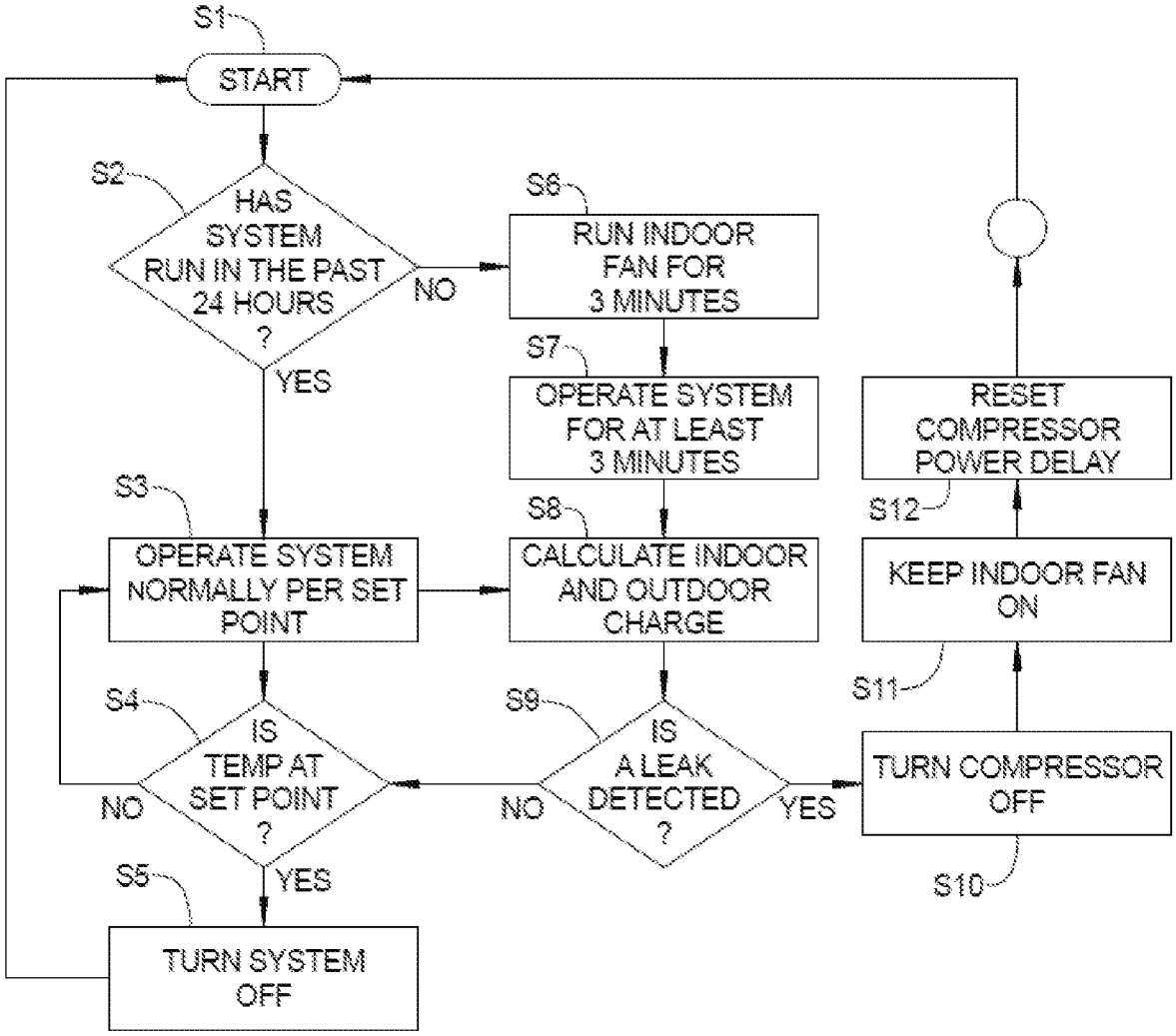
FIG. 4 is flowchart depicting an example method of controlling an indoor fan of an HVAC system.

With reference to FIG. 4, a flowchart depicting an example method of controlling a fan (e.g., fan 100) that blows air across one or more evaporators within a building is provided. The indoor fan 100 (e.g., as shown in FIG. 6) can be a whole house fan such as a furnace fan or it can be a mitigating fan, such as a bathroom fan, a hood vent fan, etc. Control starts at S1. At S2, a control module determines whether the associated refrigeration system (its compressor) has been turned on within the most recent predetermined period, such as the last 24 hours. If the refrigeration system has been turned on (ran) in the past predetermined period, control continues with S3. If not, control transfers to S6, which is discussed further below.

At S3, the control module turns on the refrigeration system (e.g., opens the isolation valves and turns on the compressor) to adjust the temperature within the building toward a set point temperature. The set point temperature may be selected via a thermostat within the building. At S4, the control module determines whether the temperature is at the set point temperature. If S4 is true, the control module turns the refrigeration system off (e.g., turns off the compressor and closes the isolation valves) at S5, and control returns to S1. If S4 is false, control returns to S3 and continues running the refrigeration system.

At S6 (when the refrigeration system has not run for within the last predetermined period), the control module turns the indoor fan on fora predetermined period, such as 3 minutes or another suitable predetermined period. At S7, the control module turns on the refrigeration system (e.g., opens the isolation valves and turns on the compressor) for the predetermined period (e.g., 3 minutes).

At S8, the control module determines the indoor and outdoor refrigerant charge amounts. The control module may determine the indoor and outdoor refrigerant charge amounts based on temperatures and/or pressures using temperature and/or pressure sensors (e.g., as discussed in FIGS. 6, 7, and 12). This may include the control module determining (e.g., real-time) densities and volume occupied by liquid, vapor, and two-phase refrigerant in the heat exchangers (evaporator(s) and condenser(s)) to calculate (e.g., real-time) refrigerant amounts within the indoor and outdoor sections using a predetermined volume of the refrigeration system and the temperatures and pressures measured, as discussed further herein.

At S9, the control module determines whether a leak is present in the refrigeration system based on the indoor and outdoor refrigerant charges relative to predetermined (e.g., previously stored) charge amounts. For example, the control module may determine that a leak is present when at least one of the indoor refrigerant charge amount is less than a predetermined indoor charge amount and the outdoor refrigerant charge amount is less than a predetermined outdoor charge amount. If no leak is detected at S9, control may transfer to S4. If a leak is detected at S9, control may continue with S10 where the control module turns the compressor OFF. Control continues with S11 where the control module maintains the indoor fan ON, such as to dissipate any leaked refrigerant that is inside the building. At S12, the control module resets the compressor power delay counter (e.g., to zero), and control returns to S1.

The control module may calculate the indoor and outdoor charges based on physical and performance characteristics, such as at least one of evaporator and condenser volume, evaporator and condenser log mean temperature difference during design, an air side temperature split, a refrigerant enthalpy change across the evaporator and/or condenser, and a ratio of overall heat transfer coefficient between two phase, vapor, and liquid of the evaporator and condenser are provided from the physical design of a system or that are observed at installation and initial operation. These characteristics may be inputs to the equations and/or lookup tables used to determine the indoor and outdoor charges or considered during calibration of the equation and/or lookup table. The control module may calculate the indoor and outdoor charges while the refrigeration system is on. The measured values can include at least one of a liquid line temperature, a suction line temperature, an outdoor ambient temperature, an evaporator temperature, a suction pressure, a condenser temperature liquid pressure, a condenser pressure, and a discharge pressure as sensed by temperature sensors and pressure sensors of the refrigeration system.

The control module may determine the indoor charge of the refrigeration system, for example, based on an evaporator charge and a liquid line charge calculation. The control module may determine an indoor total volume and a liquid line volume, for example, by performing a pump down operation, such as described above. The calculation of the indoor charge allows the control module to actively control the indoor charge amount and maintain the indoor charge amount below the predetermined amount (M1).

The calculation of indoor charge allows for optimization of refrigerant charge balance for system efficiency in response to system capacity. This may additionally include the control module controlling capacity of the compressor(s). The calculation of the total system charge allows detection and quantification of refrigerant leakage enabling an alert, an isolation of the indoor space, and a mitigation of leakage. The calculation of the total system charge also allows for calculation of total refrigerant emission.

The charge calculation may be based upon various data including fixed data including condensing unit manufacturer data may be performed as follows:

$V_{displacement}$●Compressor displacement volume (e.g., $in^3$/min);

$V_{condensing\ unit}$●Internal volume of the condensing unit between the isolating valves from the original equipment manufacturer (OEM) model geometry;

$\Delta T_{log\ mean,\ evap\ 2\phi,design}/(h_{evap\ sat}-h_{evap\ inlet})_{design}$●Standard ratio for log mean temperature difference and enthalpy change of the evaporator two phase section based on design;

$\Delta T_{log\ mean,\ evap\ vap,design}/(h_{evap\ ouletsat}-h_{evap\ sat})_{design}$●Standard ratio for log mean temperature difference and enthalpy change of the evaporator vapor section based on design; and $U_{ratio}=U_{evap\ 2\phi}/U_{evap\ vap}$●Standard value for the overall heat transfer coefficient of the two phase section ratio with the overall heat transfer coefficient of the vapor section.

The charge calculation may be further based upon variable measurement data as follows:

$T_{suction}$●Temperature of refrigerant between the vapor service valve and the vapor isolation valve (or between vapor service valve and evaporator if only one valve in the line);

$T_{liquid}$●Temperature of the refrigerant between the condenser and the liquid isolation valve (or liquid service valve in absence of isolation valves);

$P_{suction}$●Pressure of refrigerant between the vapor service valve and the vapor isolation valve (or between vapor service valve and evaporator if only one valve is implemented in the line); and $P_{liquid}$●Pressure of the refrigerant between the condenser and the liquid isolation valve (or liquid service valve in absence of isolation valves).

The charge calculated data may include a first data subset including:

$V_{indoor}$●Internal volume between the liquid isolation valve and the compressor including evaporator, liquid line, and suction line which may be calculated by rate of pressure drop during a pumpdown (or entered, such as at installation, in absence of isolation);

$T_{discharge}$●Discharge temperature of the refrigerant, such as estimated from regression model of refrigerant property data using the measured suction condition, the measured liquid pressure, and a predetermined isentropic efficiency of the compression process (e.g., in the range 60-75%);

$T_{liquid}$, $v_{liquid}$, $h_{liquid}$●Temperature, specific volume, and enthalpy of liquid refrigerant leaving the condensing unit, such as estimated from a regression model of refrigerant property data using liquid temperature;

$T_{evap\ inlet}$, $v_{evap\ inlet}$, $h_{evap\ inlet}$●Temperature, specific volume, and enthalpy of refrigerant entering the evaporator, such as estimated from a regression model of refrigerant property data using liquid temperature and suction pressure;

$T_{evap\ sat}$, $v_{evap\ sat}$, $h_{evap\ sat}$●Temperature, specific volume, and enthalpy of saturated vapor refrigerant in the evaporator(s), such as estimated from a regression model of refrigerant property data using suction pressure; and $T_{evap\ outlet}$, $v_{evap\ outlet}$, $h_{evap\ outlet}$, $\rho_{evap\ outlet}$●Temperature, specific volume, enthalpy, and density of refrigerant leaving the evaporator(s), such as estimated from a regression model of refrigerant property data using suction temperature and pressure.

The charge calculated data may include a second data subset including:

$v_{discharge}$, $h_{discharge}$●specific volume and enthalpy of refrigerant vapor entering the condensing unit, such as estimated from a regression model using discharge temperature and liquid pressure;

$T_{cond\ sat\ vap}$, $v_{cond\ sat\ vap}$, $h_{cond\ sat\ vap}$●Temperature, specific volume, and enthalpy of saturated vapor refrigerant in the condenser(s), such as estimated from a regression model using liquid pressure;

$T_{cond\ sat\ liq}$, $v_{cond\ sat\ liq}$, $h_{cond\ sat\ liq}$●Temperature specific volume and enthalpy of saturated vapor refrigerant in the condenser, such as estimated from a regression model using liquid pressure;

$U_{evap\ vap}$●Overall heat transfer coefficient in the vapor only section of the evaporator, such as only used in a ratio with the two-phase section;

$U_{evap\ 2\phi}$●Overall heat transfer coefficient in the two phase section of the evaporator, such as only used in a ratio with the vapor only section;

$V_{liquid}$●Internal volume of the liquid line between the isolation valve and the expansion valve; and $V_{evaporator}$●Internal volume of the evaporator and suction line.

A pumpdown commissioning calculating includes the control module calculating the total volume of the indoor system and the volume of the liquid line based on, for example, a total amount of refrigerant removed during a pump down and a rate of change in pressure and density during the pumpdown after liquid refrigerant has been removed. The use of a vapor pumpdown rate of change in pressure and density may be used by the control module to estimate total volume. This may be described by the following equations:

$$\text{Total Pump out Charge Mass}=\Sigma(\rho_{evap\ outlet}\cdot V_{displacement}\cdot\Delta t_{measurement}),$$ during the full duration of the pump out;

$$V_{indoor}=\Sigma[(V_{displacement}\cdot\rho_{evap\ outlet}\cdot\Delta t_{measurement})/(\rho_{evap\ outlet,previous\ measurement}-\rho_{evap\ outlet})];$$ in the time after all liquid has been removed as observed by a (e.g., sharp) change in the suction pressure; and $$\text{Total Pump out Charge Mass}=V_{liquid}/V_{liquid}+2\cdot\%A_{2\phi}\cdot V_{evaporator}/(v_{evap,in}+v_{evap,sat})+2\cdot\%A_{vap}\cdot V_{evaporator}(v_{evap,sat}+v_{evap\ outlet})$$

Balancing the three equations above using data from an end of a run cycle of the refrigeration system before the pump out may be used to populate the third combined equation with the pum pout calculations from the $1^{st}$ and $2^{nd}$ equations. With the three above equations, $V_{liquid}$ and $V_{evaporator}$ can be solved by the control module. In the absence of actuated isolation valves, $V_{liquid}$ and $V_{evaporator}$ may be estimated by an installer and stored.

The operating calculation of indoor charge may use a standard equation isolating vapor heat transfer, such as follows:

$$Q_{evap\ vap}=m_{evap\ outlet}\cdot(h_{evap\ outlet}-h_{evap\ sat});$$ and $$Q_{evap\ 2\phi}=m_{evap\ outlet}\cdot(h_{evap\ sat}-h_{evap\ inlet}).$$

An equation for compressor mass flow rate is as follows:

$$m_{evap\ outlet}=V_{displacement}\cdot\rho_{evap\ outlet}.$$

The present disclosure enables use of design condition data from the OEM to calculate the percent of the heat transfer area (% A) of the evaporator used for 2-phase heat transfer and for superheating vapor by the control module. The formulas above may be based on thermodynamic physical calculations with the assumption that some ratios will be consistent between daily operation and an OEM design condition.

A heat transfer by region may be calculated as follows:

$$Q_{evap\ vap}=U_{evap\ vap}\cdot\%A_{vap}\cdot A_{tot}\cdot\Delta T_{log\ mean,vap};$$

$$Q_{evap\ 2\phi}=U_{evap\ 2\phi}\cdot\%A_{evap\ 2\phi}\cdot A_{tot}\cdot\Delta T_{log\ mean,evap\ 2\phi};$$

A percent of area for vapor and 2-phase may be calculated as follows:

$$\%A_{vap}=m_{evap\ outlet}\cdot(h_{evap\ outlet}-h_{evap\ sat})/(U_{evap\ vap}\cdot A_{tot}\cdot\Delta T_{log\ mean,vap});$$

$$\%A_{evap\ 2\phi}=m_{evap\ outlet}\cdot(h_{evap\ sat}-h_{evap\ inlet})/(U_{evap\ 2\phi}\cdot A_{tot}\cdot\Delta T_{log\ mean,evap\ 2\phi});$$

A ratio of percent of area for vapor and 2-phase may be calculated as follows:

$$\%A_{vap}/\%A_{evap\ 2\phi}=(h_{evap\ outlet}-h_{evap\ sat})\cdot U_{evap\ 2\phi}\cdot\Delta T_{log\ mean,evap\ 2\phi}/[(h_{evap\ sat}-h_{evap\ inlet})\cdot U_{evap\ vap}\cdot\Delta T_{log\ mean,vap}];$$

$$\%A_{vap}+\%A_{evap\ 2\phi}=1.$$

A log mean temperature difference of each region may be calculated as follows:

$$\Delta T_{log\ mean,evap\ 2\phi}=[\Delta T_{log\ mean,evap\ 2\phi,design}/(h_{evap\ sat}-h_{evap\ inlet})_{design}]\cdot(h_{evap\ sat}-h_{evap\ inlet});$$ and $$\Delta T_{log\ mean,evap\ vap}=[\Delta T_{log\ mean,evap\ vap,design}/(h_{evap\ outlet}-h_{evap\ sat})_{design}]\cdot(h_{evap\ outlet}-h_{evap\ sat}).$$

The calculations described herein may be calculated by a control module. The calculation of total indoor charge may be completed using properties of refrigerant specific volume. Specific volume may be approximately linearly related to enthalpy within each phase region allowing inlet and outlet of the phase region to calculate a reliable average specific volume for the phase region. By combining this with calculating a percent of a heat transfer area of the evaporator used for 2-phase heat transfer and for vapor superheating, the evaporator refrigerant mass is calculated by the control module. With known liquid density upstream of the expansion device and a liquid line volume, the liquid line refrigerant mass can be calculated by the control module for combination to estimate an indoor refrigerant charge amount (e.g., mass) according to the following equation:

$$\text{Indoor refrigerant charge mass}=\text{Liquid line refrigerant mass}+\text{Evaporator refrigerant mass};$$

where $$\text{Liquid line refrigerant mass}=V_{liquid}/v_{liquid};$$ and $$\text{Evaporator refrigerant mass}=2\cdot\%A_{2\phi}\cdot V_{evaporator}/(V_{evap,in}+V_{evap,sat})+2\cdot\%A_{vap}\cdot V_{evaporator}(v_{evap,sat}+v_{evap\ outlet}).$$

A similar calculation can be performed by the control module to determine the condenser or outdoor side ($M_{outdoor}$) amount (e.g., mass m) in order to observe a change in the total mass ($M_{indoor}+M_{outdoor}$). The control module may determine whether a leak is present based on the change in the total mass. Additionally or alternatively, the outdoor side amount may be used by the control module to determine when there is a leak in the system. Less than 4 ounce charge removals can be observed in the calculation when there is not a charge reservoir like an accumulator or receiver.

The calculated indoor charge may be used by the control module to verify while running that the indoor charge amount is maintained less than the predetermined (M1) amount as determined by the refrigerant concentration limit (RCP). The RCP limit may be 25% of a lower flammability limit for the A2L refrigerant and other flammable refrigerants. The (e.g., total) charge amount at the end of the on-cycle is held constant through the off cycle with the use of charge isolation valves.

To summarize, the control module may control the isolation valves to maintain a (e.g., indoor) charge amount below the predetermined amount (M1) inside an occupied building. Other ways to determine the amount of refrigerant within a system may be used, such as those based on installation, commissioning, continuous commissioning, service contract monitoring, and servicing of the system. The indoor charge amount $M_{indoor}$ (i.e. mass) can be confirmed to be below the predetermined amount (M1) or another suitable amount allowed according to one or more regulations.

The refrigerant of the vapor compression system can be a refrigerant such as R-410A, R-32, R-454B, R-444A, R-404A, R-454A, R-454C, R-448A, R-449A, R-134a, R-1234yf, R-1234ze, R-1233zd, or other type of refrigerant. The properties of the refrigerant used to determine the densities and volume occupied may be calculated by the control module based on the measured values and the properties of the refrigerant.

The evaporator and condenser (heat exchangers) may include finned tube, concentric, brazed plate, plate and frame, microchannel, or other heat exchangers with (e.g., constant) internal volume. There may be a single evaporator and condenser or multiple parallel evaporators or condensers, such as discussed above. Refrigerant flow can be controlled via a capillary tube, thermostatic expansion valve, electric expansion valve, or other methods.

As detailed above with respect to FIG. 4, the amount of refrigerant may be determined by the control module based on measurements from the pressure and temperature sensors, such as those shown in FIG. 6. FIG. 6 provides a method of controlling the isolation valves to isolate refrigerant charge in outdoor components of a refrigeration system based on the calculated refrigerant charge amount. Isolation control of some type may be present on both the liquid and suction line including at least one of dedicated isolation valves, a positive seat compressor, a suction check valve, and a positive seat electronic expansion valve. The isolation valve control can react automatically or in response to control in changes in the system operational state and the identification of a leak.

The isolation valves 20, 22 may be actuated (e.g., closed) by the control module at the end of an operational cycle (e.g., when the refrigeration system is turned off), such as to ensure that the indoor charge amount does not exceed the predetermined amount (M1). The isolation valves 20, 22 are opened by the control module at startup of the refrigeration system. This permits starting of the compressor 12 by the control module. While the refrigeration system is off, refrigerant charge balance between the indoor and outdoor sections may be controlled by the control module by controlling, for example, auxiliary heat or cooling. This may enable shorter periods of instability and low (compressor) capacity at the beginning of an operational cycle (e.g., when the refrigeration system is turned on). This may reduce energy loss caused by the operational (on/off) cycling of the refrigeration system. The indoor charge of a flammable refrigerant is maintained by the control module below the predetermined amount (M1).

In the example of FIG. 6, the control module closes the isolation valves 20, 22 when a leak is detected to isolate the refrigerant charge outside of the building to prevent continued leaking of refrigerant within the building. When the compressor is running, the liquid-side isolation valve 22 may be closed by the control module while the suction side isolation valve is held open upon detection of a leak. This may allow the refrigerant to be pumped out of and isolated outside of the building. The control module may operate the compressor(s) and hold the suction side isolation valve(s) open, for example, until a predetermined suction pressure and/or a predetermined evaporator temperature is reached. This may indicate that the predetermined amount (M1) has been achieved indoors. The control module may switch the compressor(s) off and close all isolation valves. The isolation valves 20, 22 are sequentially closed in advance of the end of the operational cycle to permit valve closing to align in time with the end of the cycle. Manual or automatic actuation of the isolation valves allows isolation of the system for service or commissioning. In various implementations, the isolation valves may be condensing unit valves retrofitted with (electronic) automated actuators.

A pump down can be performed by the control module during commissioning, for example, to establish the volume and operating indoor charge or liquid line volume on the indoor section of the isolation valves 20, 22. The volume data can be stored for future reference, such as for use in the charge calculation equation.

For example, during actual testing using the pump down technique described herein in a residential home HVAC system charged with 15 pounds (Lbs) 8 ounces (oz) of refrigerant, after operation of the HVAC system with no pump down, 3 Lbs. 4 oz. of refrigerant was pumped down from the indoor section of the HVAC system to the outdoor section of the HVAC system. In an HVAC system charged with 15 Lbs. 8 oz. of refrigerant, after operation of the system with a 15 second pump down, 1 Lb. 6.2 oz. of refrigerant was pumped out of (recovered from) the indoor section of the HVAC system. Finally, in an HVAC system charged with 15 Lbs. 8 oz. of refrigerant, after operation of the system with no pump down, just 7.2 oz. of refrigerant was recovered from the indoor section of the HVAC system.

Figure 7:
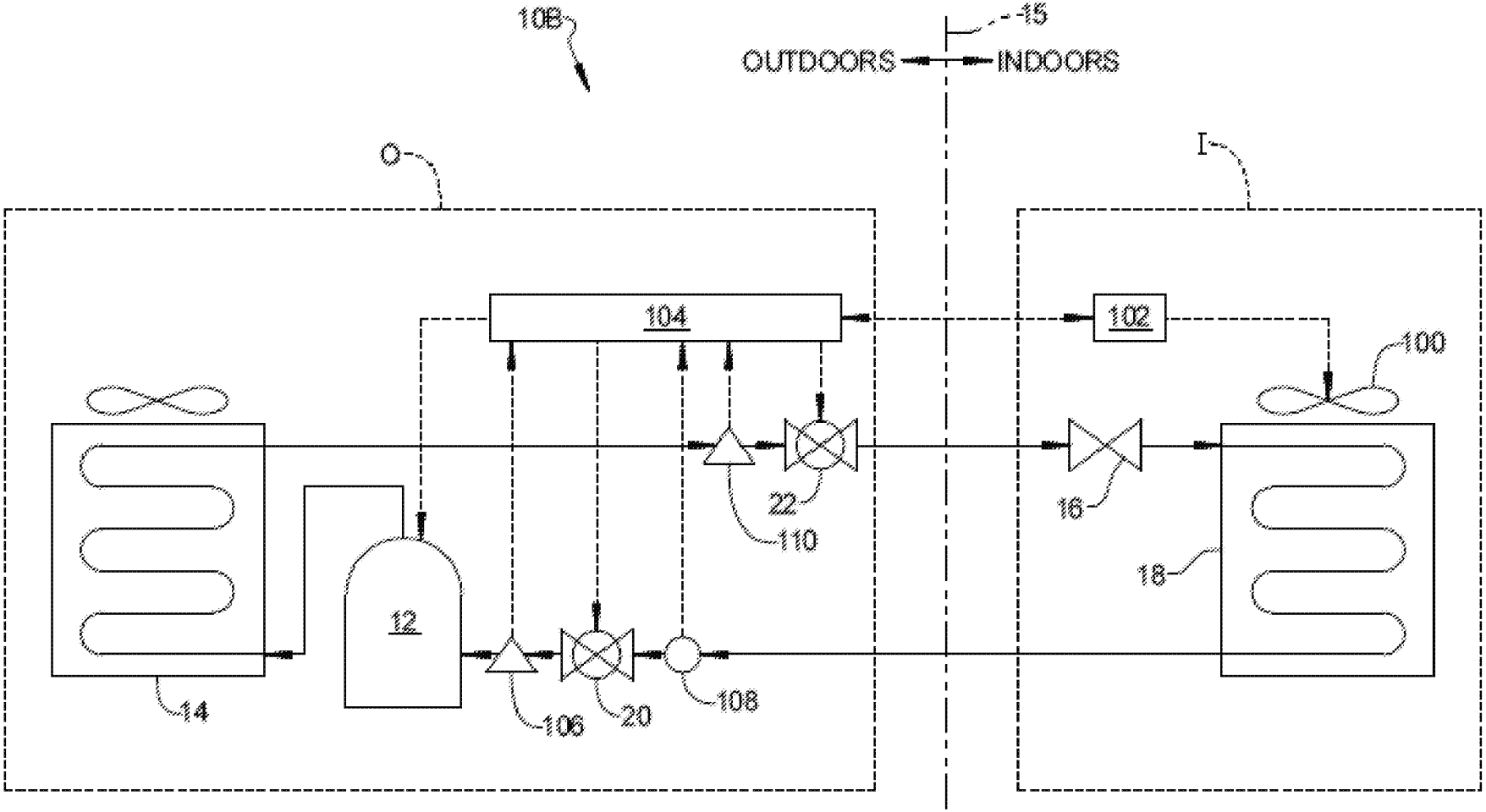
FIG. 7 is a functional block diagram of an example air conditioning system including isolation valves, pressure sensors, and temperature sensors.

With reference to FIG. 7 a functional block diagram of an example refrigeration system 10B including isolation valves and pressure and temperature sensors is provided. As shown in FIG. 7, the refrigeration system includes a compressor 12 and a condenser 14 disposed outdoors of a building 15 (i.e., outdoors). An expansion valve 16 and an evaporator 18 are disposed inside of the building 15 (i.e., indoors).

A first isolation valve 20 is disposed, for example, outside of the building and between the evaporator 18 and the compressor 12. A second isolation valve 22 is disposed, for example, outside of the building and between the condenser 14 and the expansion valve 16.

A fan 100 is provided adjacent to the evaporator 18 and blows air across the evaporator 18 when on. A first control module 102 controls operation of the fan 100. A second control module 104 calculates indoor and outdoor charge amounts, for example, based on measurements from a first temperature sensor 106 and a first pressure sensor 108 disposed between the evaporator 18 and the compressor 12 and a second temperature sensor 110 disposed between the condenser 14 and the expansion valve 16. The control module may determine the indoor and outdoor charge amounts while the refrigeration system is ON. If an overall system charge amount decreases, the control module may determine that a leak is present. The control module may determine the overall (or total) system charge amount, for example, based on or equal to a sum of the indoor and outdoor charge amounts.

If a leak is detected, the second control module 104 may initiate a pump out. This may include the second control module 104 closing the second isolation valve 22 and running the compressor 12. This may pump down refrigerant from the indoor side I to the outdoor side O of the refrigeration system. The second control module 104 may close the first isolation valve 20 and turn off the compressor to isolate the outdoor section O of the system from the indoor section I of the system when the pump down is complete. The second control module 104 may prompt the first control module 102 to turn ON the fan 100 and/or one or more other mitigation devices, such as to dissipate/dilute any leaked refrigerant within the building. The pressure sensor 108 can be used to detect a leak by detecting a pressure decay from the indoor side of the system 10B.

Figure 8:
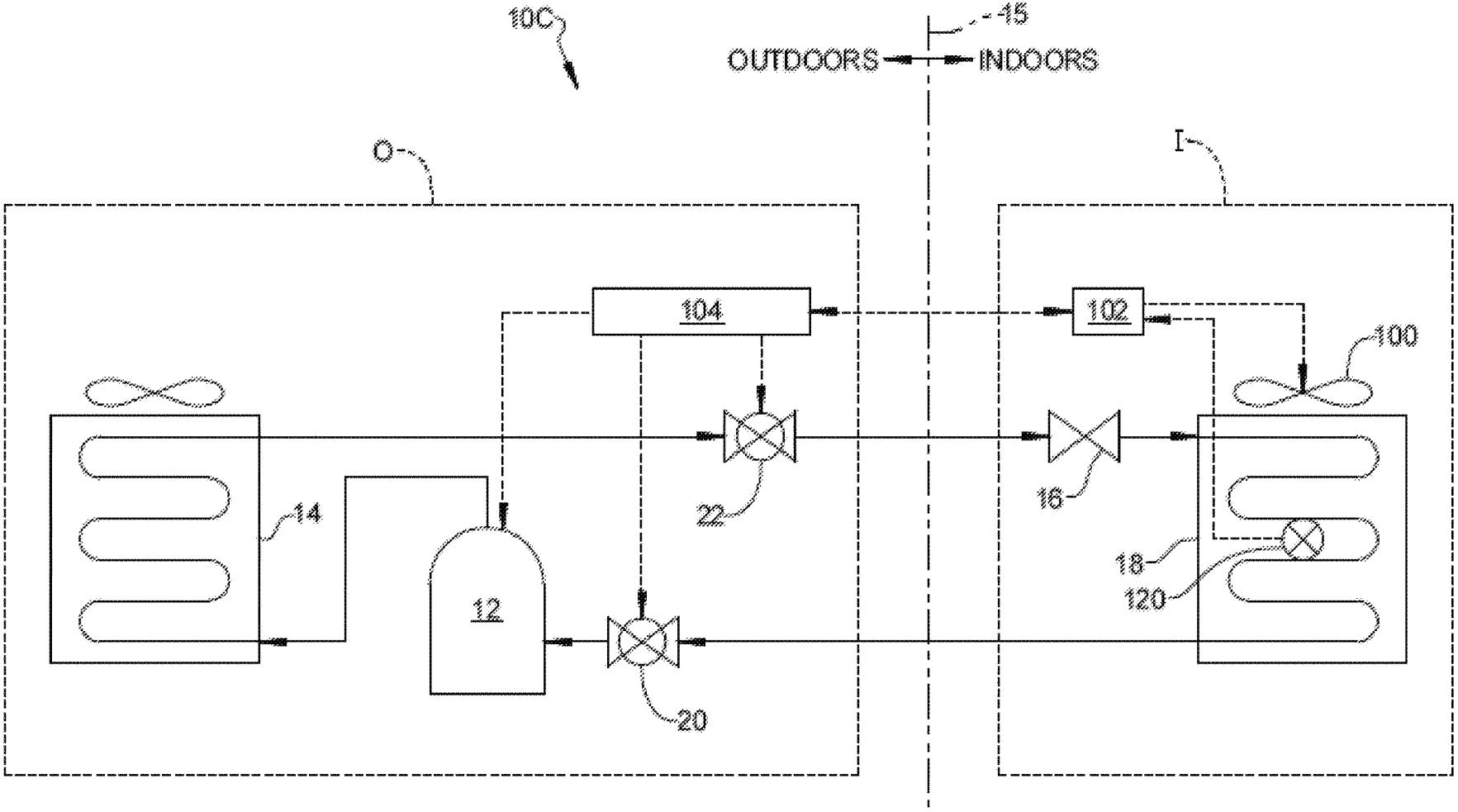
FIG. 8 is a functional block diagram of an example air conditioning system for including isolation valves and a leak sensor.

With reference to FIG. 8 a functional block diagram of an example implementation of a refrigeration system 10C is presented. The refrigeration system may include compressor 12 and a condenser 14 outside of a building 15 (i.e., outside). An expansion valve 16 and an evaporator 18 is disposed inside of the building 15 (i.e., indoors.

A first isolation valve 20 is disposed, for example, inside of the building and between the evaporator 18 and the compressor 12. A second isolation valve 22 is disposed, for example, outside of the building and between the condenser 14 and the expansion valve 16.

A fan 100 is provided adjacent to the evaporator 18 and is controlled by a first control module 102. A second control module 104 may control the compressor 12 and the isolation valves 20, 22, such as in response to signals from the first control module 102.

A refrigerant leak sensor 120 is provided in the indoor unit and can be adjacent to the evaporator 18. The refrigerant leak sensor 120 may indicate whether a refrigerant leak is present. In the system of FIG. 8, the first control module 102 receives signals from the leak sensor 120 and communicates with the second control module 104 if a leak is detected. When a leak is detected, the second control module 104 initiates a pump down sequence. This may include closing the second isolation valve 22 and running the compressor 12 to pump down refrigerant from inside of the building to the outside of the building. The second control module 104 closes the first isolation valve 20 and turns off the compressor 12 when the pump down is complete to isolate the outdoor section O of the system from the indoor section I of the system.

The second control module 104 also communicates with the first control module 102, such as to turn ON the fan 100 and/or one or more other mitigation devices, such as to dissipate any leaked refrigerant or prevent/lockout operation of any ignition sources. The isolation valves 20, 22, compressor 12, or expansion device 16 control the total refrigerant charge, such as to minimize or maintain the charge amount less than the predetermined amount (M1) during both compressor operational and compressor non-operational times.

Figure 9:
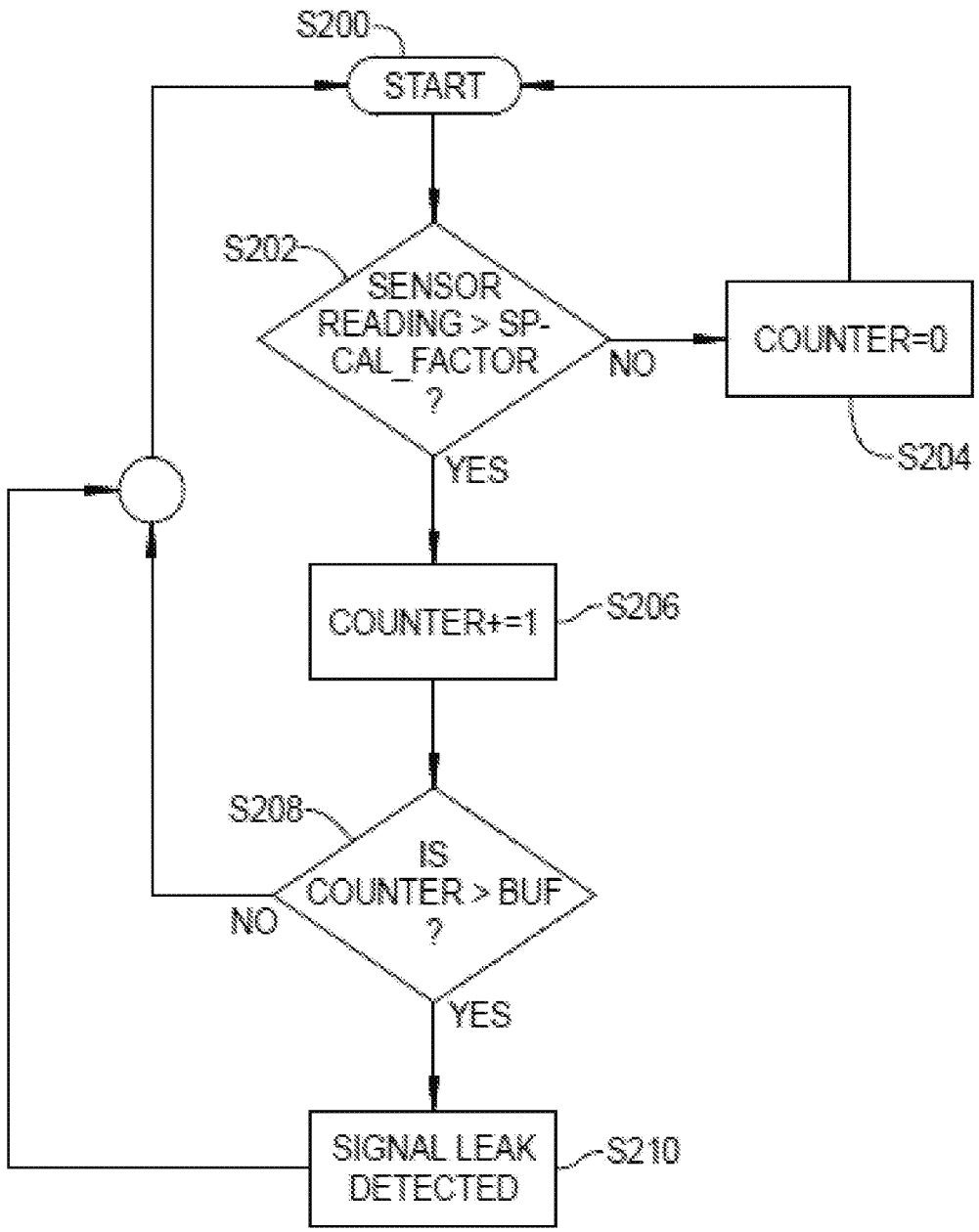
FIG. 9 is an flowchart depicting an example method of refrigerant leak detection.

FIG. 9 is flowchart depicting an example method of refrigerant leak detection using a leak sensor 120. Control begins with S200. At S202, a control module determines whether a measurement of the leak sensor is greater than a predetermined value. For example, the leak sensor may measure a concentration of the refrigerant in air at the leak sensor. When the concentration (e.g., parts per million or parts per billion) is not greater than the predetermined concentration or amount, control continues with S204. In various implementations, a calibrated amount may be subtracted from the predetermined value (or set point, SP). At S204 the control module sets a counter value to zero and control returns to S200. If the control module determines whether the measurement from the sensor is greater than the predetermined value, control continues with S206.

At S206, the control module increments the counter value (e.g., by 1), and control continues with S208. At S208, the control module determines whether the counter value is greater than a predetermined value. If S208 is true, the control module determines and indicates that a leak is present at S210, and control returns to S200. If S208 is false, the control module may determine that s leak is not present, and control returns to S200. The predetermined value is greater than zero and may be greater than 1. By requiring the counter value to be greater than 1, control ensures that an actual leak is present by requiring that the measurement be greater than the predetermined value for multiple consecutive sensor readings. This may avoids nuisance alerts/lockouts regarding leakage.

Figure 10:
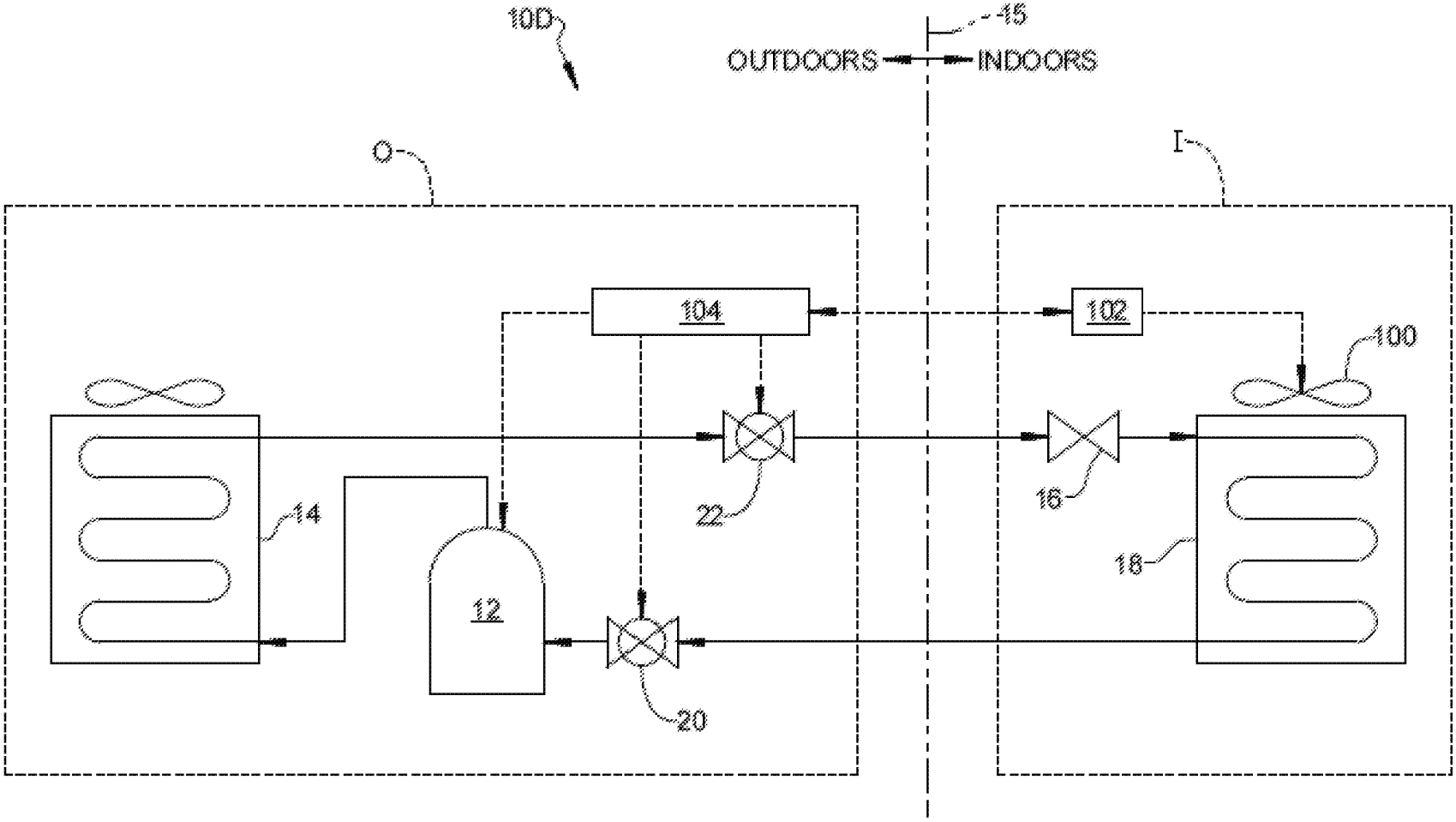
FIGS. 10 and 11 are functional block diagram of example refrigeration systems including isolation valves.

FIG. 10 is a functional block diagram of an example refrigeration (e.g., air conditioning) system 10D. The system 10D includes a compressor 12 and a condenser 14 disposed outside of the building 15 (i.e., outdoors), and includes an expansion valve 16 and an evaporator 18 disposed inside of the building 15 (i.e., indoors).

A first isolation valve 20 is disposed, for example, outside of the building 15, and between the evaporator 18 and the compressor 12. A second isolation valve 22 is disposed, for example, outside of the building 15, and between the condenser 14 and the expansion valve 16.

A fan 100 is provided adjacent to the evaporator 18 may be controlled by a first control module 102. When on, the fan 100 blows air across the evaporator 1. A second control module 104 may control the compressor 12 and the isolation valves 20, 22.

In the example of FIG. 10, the first control module 102 communicates with the second control module 104 to indicate whether cooling is demanded or not. For example, the first control module 102 may set a signal to a first state when cooling is demanded and set the signal to a second state when cooling is not demanded. While the example of separate control modules (first and second control modules) is described herein, in various implementations, the multiple control modules may be integrated within a single control module.

The second control module 104 may selectively perform a pump down, such as when a leak is detected or when a cooling demand stops. The pump down may include the second control module 104 closing the second isolation valve 22 closed and maintaining the compressor 12 on for a predetermined period. After the predetermined period has passed, the second control module 104 may close the first isolation valve 20 and turn off the compressor 12. This may isolate refrigerant in the outdoor section O of the system and isolate refrigerant from the indoor section I. This may ensure that the amount of refrigerant within the indoor section I when the compressor 12 is off is less than the predetermined amount (M1).

Figure 11:
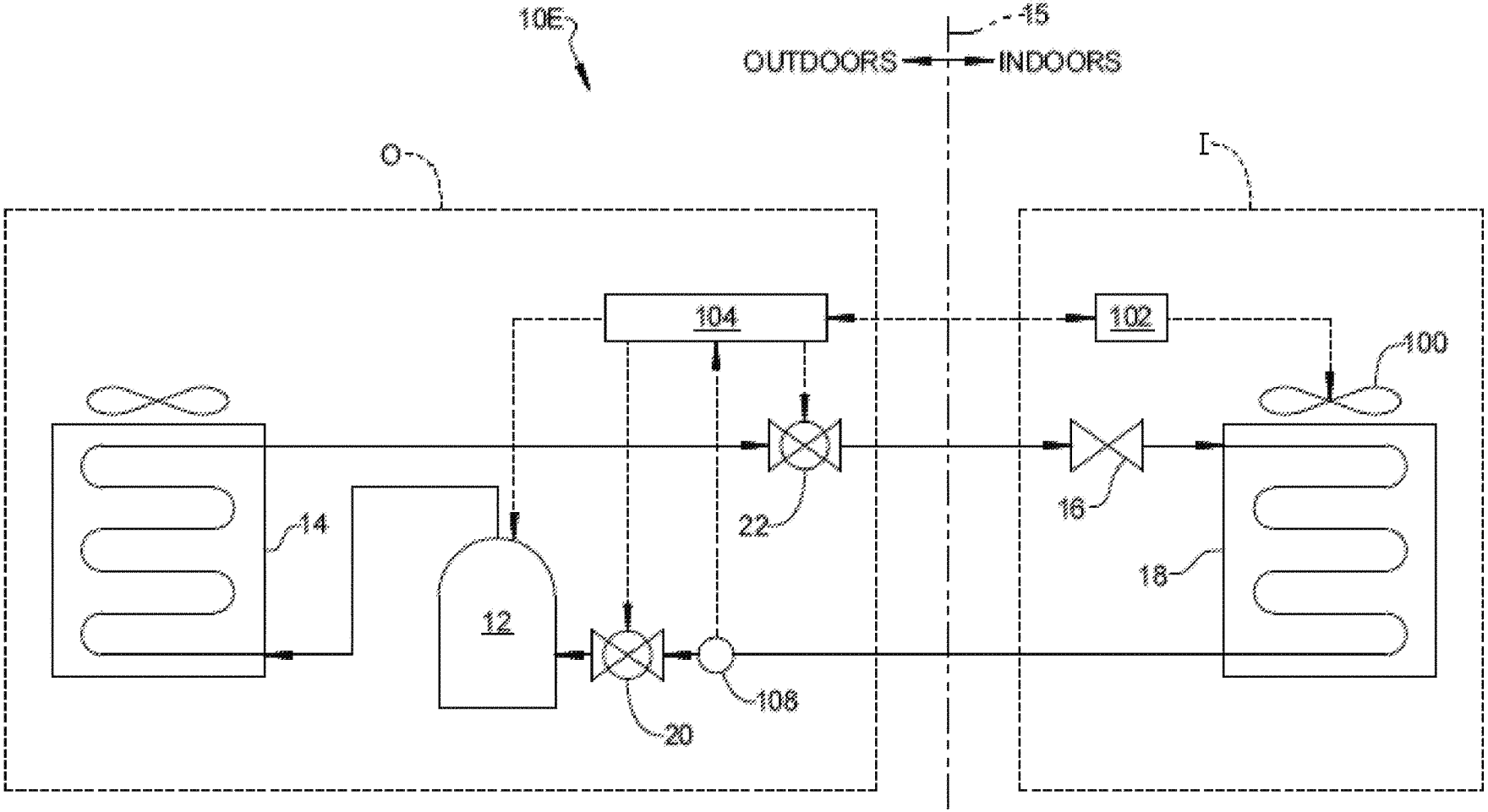

FIG. 11 includes a functional block diagram of an example refrigeration (e.g., air conditioning) system 10E. The system 10E is shown including a compressor 12 and a condenser 14 disposed outside of the building 15 (i.e., outdoors) and includes an expansion valve 16 and an evaporator 18 disposed inside of the building 15 (i.e., indoors).

A first isolation valve 20 is disposed, for example, outside of the building 15 and between the evaporator 18 and the compressor 12. A second isolation valve 22 is disposed, for example, outside of the building 15, and between the condenser 14 and the expansion valve 16.

A fan 100 is provided adjacent to the evaporator 18 and may be controlled by a first control module 102. When on, the fan 100 blows air across the evaporator 18, such as to cool the air within the building 15. A second control module 104 may control the compressor 12 and the isolation valves 20, 22.

The first control module 102 communicates with the second control module 104 to indicate whether cooling has been demanded, such as described above. The second control module 104 can selectively perform a pump down, such as when the demand for cooling stops. This may include the second control module 104 closing the second isolation valve 22 closed and maintaining the compressor 12 on for a predetermined period after the demand for cooling ends. Once the predetermined period has passed, the second control module 104 may turn off the compressor 12 and close the first isolation valve 20. This may isolate the refrigerant in the outdoor section O of the system such that the amount of refrigerant within the indoor section I is less than the predetermined amount (M1) while the compressor 12 is off.

A pressure sensor 108 can be disposed between the evaporator 18 and the first isolation valve 20. Additionally or alternatively, a pressure sensor (or the pressure sensor 108) can be disposed between the expansion valve 16 and the isolation valve 22.

The pressure sensor 108 measure the pressure in the indoor section I, such as for a decay in pressure, when the system is off (e.g., the isolation valves are closed and the compressor 12 is off). The second control module 104 may determine and indicate that a refrigerant leak is present when the pressure (or an absolute value of the pressure) measured by the pressure sensor 108 decays (e.g., decreases by at least a predetermined amount). When a leak is detected, the second control module 104 may prompt the first control module 102 to turn the fan 100 ON. A control module may also turn on one or more other mitigation devices in order to dissipate/dilute the refrigerant within the building.

Figure 12:
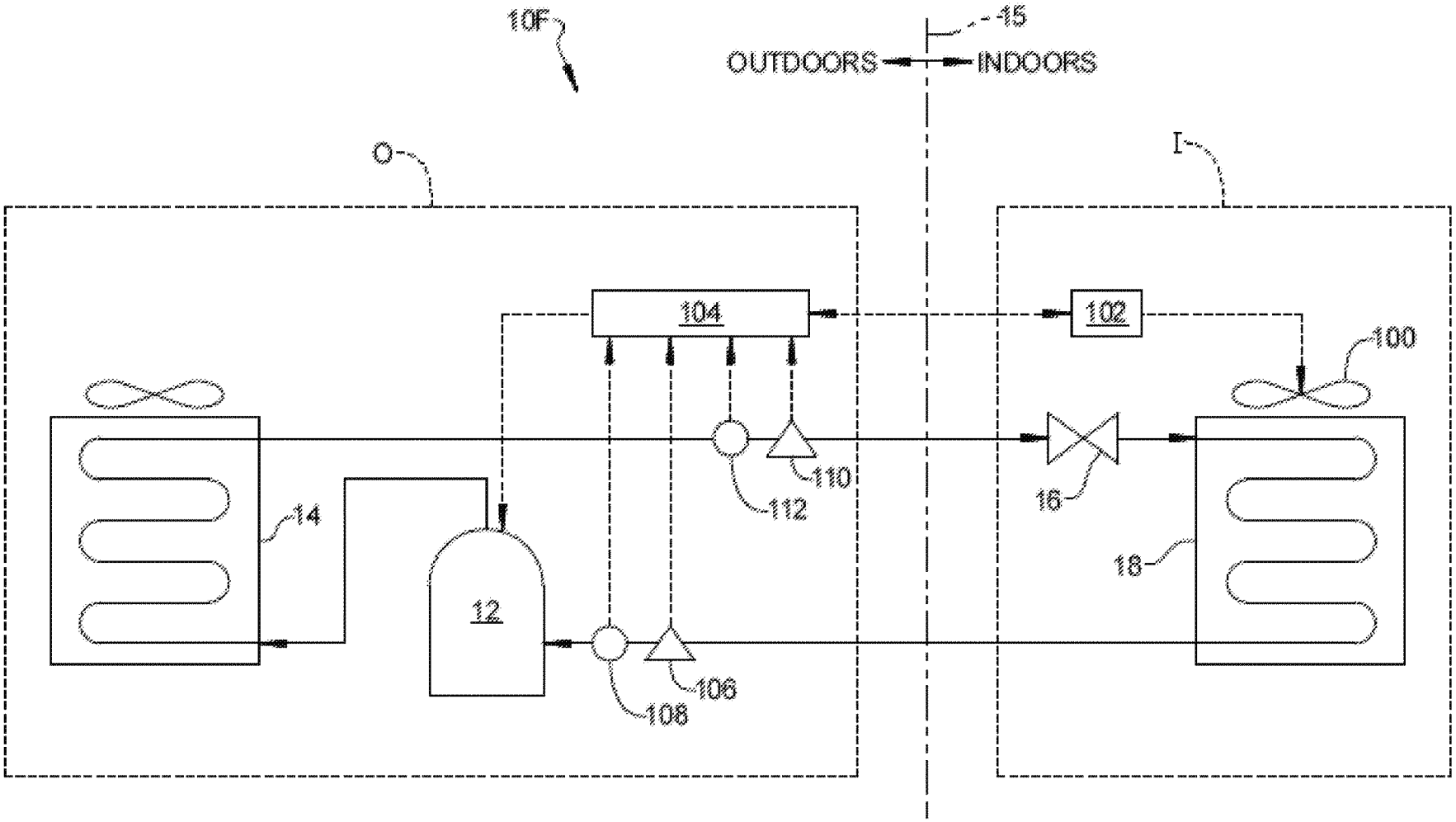
FIG. 12 is a functional block diagram of an example refrigeration system including pressure and temperature sensors.

FIG. 12 is a functional block diagram of an example refrigeration (e.g., air conditioning) system 10F. The system 10F is shown including a compressor 12 and a condenser 14 disposed outside of the building 15 (i.e., outdoors) and includes an expansion valve 16 and an evaporator 18 disposed inside of the building 15 (i.e., indoors).

A fan 100 is provided adjacent to the evaporator 18 may be controlled by a first control module 102. When on, the fan 100 blows air across the evaporator 18, such as discussed above. A second control module 104 may control the compressor 12. The second control module 104 may calculate indoor and outdoor charge amounts based on measurements from a first temperature sensor 106 and a first pressure sensor 108 disposed between the evaporator 18 and the compressor 12 and based on measurements from a second temperature sensor 110 and a second pressure sensor 112 disposed between the condenser 14 and the expansion valve 16. The amount of indoor and outdoor charge level may be calculated while the HVAC system is ON (e.g., the compressor is ON and the isolation valve(s) are open) based upon the measurements of the pressure sensors 108, 112 and the temperature sensors 106, 110. The second control module 104 may determine the indoor charge amount, for example, using an equation or a lookup table that relates the measured pressures and temperatures to indoor charge amounts. The second control module 104 may determine the outdoor charge amount, for example, using an equation or a lookup table that relates the measured pressures and temperatures to outdoor charge amounts.

The second control module 104 may determine a total (overall) system charge amount based on the indoor and outdoor charge amounts. The second control module 104 may determine the total charge amount, for example, using an equation or a lookup table that relates the indoor and outdoor charge amounts to total charge amounts. For example, the second control module 104 may set the total charge amount based on or equal to the indoor charge amount plus the outdoor charge amount.

If the total charge amount decreases, the second control module 104 may determine and indicate that a leak is present. If a leak is detected, the second control module 104 may turn off the compressor 12. The second control module 104 may prompt the first control module 102 to turn ON the fan 100. A control module may also turn on one or more other mitigation devices to dilute/dissipate any leaked refrigerant.

Figure 13:
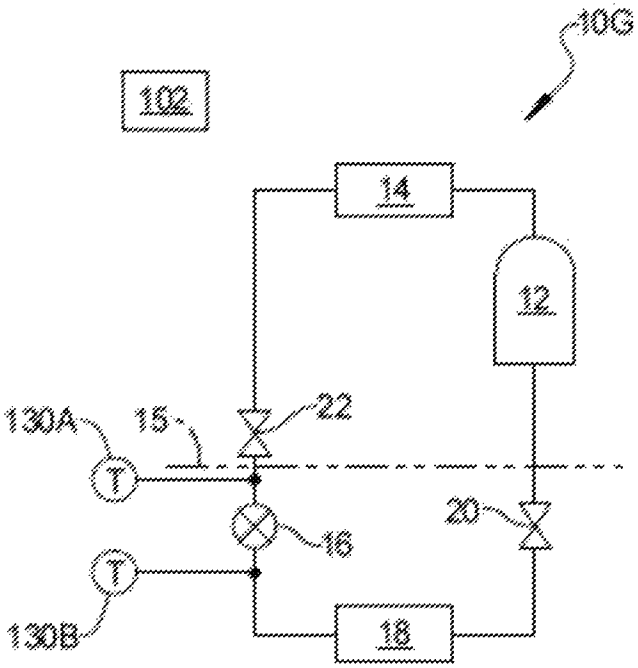
FIG. 13 is a functional block diagram of an example refrigeration system including temperature or pressure sensors.

FIG. 13 is a functional block diagram of an example refrigeration (e.g., air conditioning) system 10G. The system 10G is shown including a compressor 12 and a condenser 14 disposed outside of the building 15 (i.e., outdoors) and includes an expansion valve 16 and an evaporator 18 disposed inside of the building 15 (indoors).

A first isolation valve 20 is disposed between the evaporator 18 and the compressor 12. A second isolation valve 22 is disposed, for example, outside of the building, and between the condenser 14 and the expansion valve 16. A control module 102 controls the compressor 12 and the isolation valves 20, 22.

The control module 102 receives signals from a pair of pressure sensors and/or a pair of temperature sensors 130A, 130B, that make measurements across (i.e., on opposite sides of) the expansion valve 16. The control module 102 monitors the measurements from the temperature and/or pressure sensors 130A, 130B while the isolation valves 20, 22 and the expansion valve 16 are closed to determine whether a leak is present through the expansion valve. For example, the control module 102 may determine whether a leak is present through the expansion valve when temperature and/or pressure (e.g., across the expansion valve 16) changes by at least a predetermined amount. Because the isolation valves 20 and 22 and the expansion valve 16 should be closed, a leak through the expansion valve 16 may be present when a temperature difference across the expansion valve and/or a pressure difference across the expansion valve measured by the sensors 130A, 130B changes by at least a predetermined amount while the valves 20, 22, and 16 are closed.

Leakage through the expansion valve 16 causes cooling of the refrigerant downstream of the expansion valve 16. When a leak is detected, the control module 102 can turn on a fan that blows air across the evaporator 18 (e.g., fan 100) and/or one or more other mitigation devices. The control module 102 may additionally turn off or lock out any ignition source.

In the example of FIG. 13, positive-sealing isolation valves 20, 22 are used. To verify that the leak is through the expansion valve 16 and not an isolation valve, the control module 102 may perform one or more diagnostics to verify that the isolation valves 20, 22 do not have a leak. The pressure or temperature sensors 130A, 130B are installed to observe the saturation temperature or pressure of the isolated refrigerant in relation to the ambient temperature or pressure while in the non-operating period.

Figure 14:
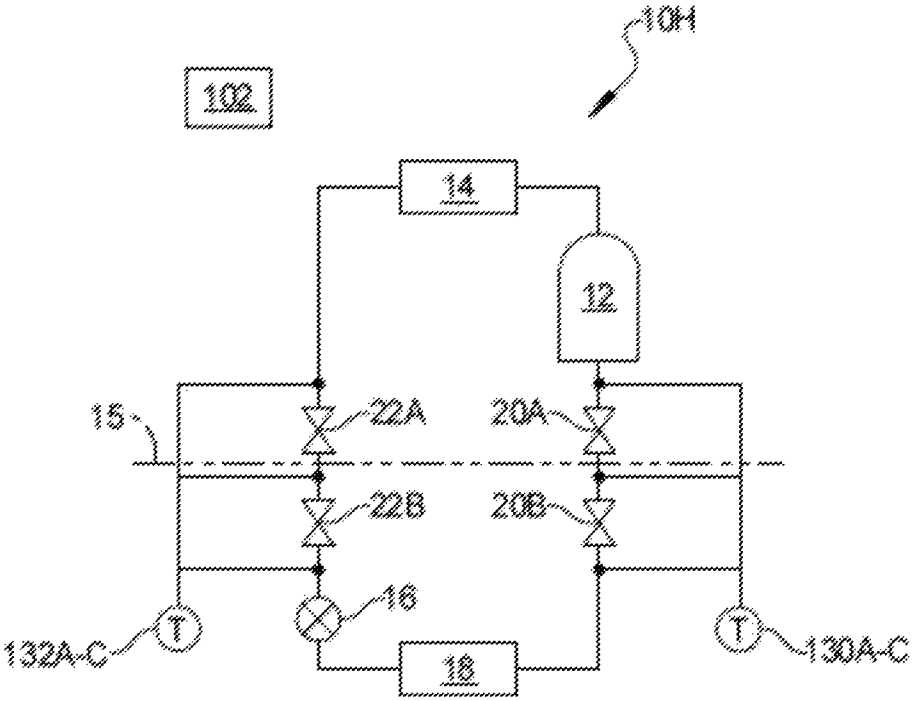
FIG. 14 is a functional block diagram of an example refrigeration system including redundant isolation valves and temperature or pressure sensors.

With reference to FIG. 14, a functional block diagram of an example refrigeration (e.g., air conditioning) system 10H is provided. The system 10H is shown including a compressor 12 and a condenser 14 disposed outside of the building 15 (i.e., outdoors) and includes an expansion valve 16 and an evaporator 18 disposed inside of the building 15 (i.e., indoors).

A first pair of isolation valves 20A, 20B are disposed between the evaporator 18 and the compressor 12 with one isolation valve 20A on the outdoor side and one isolation valve 20B on the indoor side. A second pair of redundant isolation valves 22A, 22B are disposed between the condenser 14 and the expansion valve 16 with one isolation valve 22A on the outdoor side and one isolation valve 22B on the indoor side.

A control module 102 controls the compressor 12 and the isolation valves 20A, 20B, 22A, 22B. The control module 102 receives measurements from temperature sensors 130A, 130B, 130C. The temperature sensor 130A is disposed (and measures) upstream of the isolation valves 20A, 20B, between the evaporator 18 and the isolation valve 20B. The temperature sensor 130B is disposed (and measures) between the isolation valves 20A, 20B. The temperature sensor 130C is disposed (and measures) downstream of the isolation valves 20A, 20B, between the isolation valve 20A and the compressor 12. The control module 102 also receives measurements from temperature and/or pressure sensors 132A, 132B, 132C. The sensor 132A is disposed (and measures) upstream of the isolation valves 22A, 22B, between the condenser 14 and the isolation valve 22A. The sensor 132B is disposed (and measures) between the isolation valves 22A, 22B. The sensor 132C is disposed (and measures) downstream of the isolation valves 22A, 22B, between the isolation valve 22A and the evaporator 18.

The control module 102 monitors the measurements from the sensors 130A, 130B, 130C, 132A, 132B, 132C with the isolation valves 20, 22 and the expansion valve 16 all closed to determine whether a leak is present. The control module 102 may determine that a leak is present when one or more measurements or differences between two or more measurements change by at least a predetermined value. If so, the control module 102 may determine that a leak is present.

When a leak is detected, the control module 102 may turn on a fan (e.g., the fan 100) and/or one or more other mitigation devices. This may dissipate or dilute any leaked refrigerant. The redundant isolation valves 20B and 22B may be used to provide additional protection to isolate refrigerant outside of the building.

According to an additional method of the present disclosure, a pump out (removal) procedure can be performed at the end of a cooling season (e.g., at a predetermined date and time, such as October 1 in the northern hemisphere). This may allow for low levels of leakage through the isolation valves back into the indoor coil of an HVAC system with charge isolation. Additionally or alternatively, a pump out procedure can be performed when the refrigeration system has continuously been off for a predetermined number of days (e.g., 14 days or another suitable number of days). A standard maximum leakage rate for the isolation valves when closed may be a predetermined value. The control module may track the period since a last pump down while the system has continuously been off and perform another pump down to prevent the indoor charge amount from exceeding the predetermined amount (M1) based on the standard maximum leakage rate.

Figure 15:
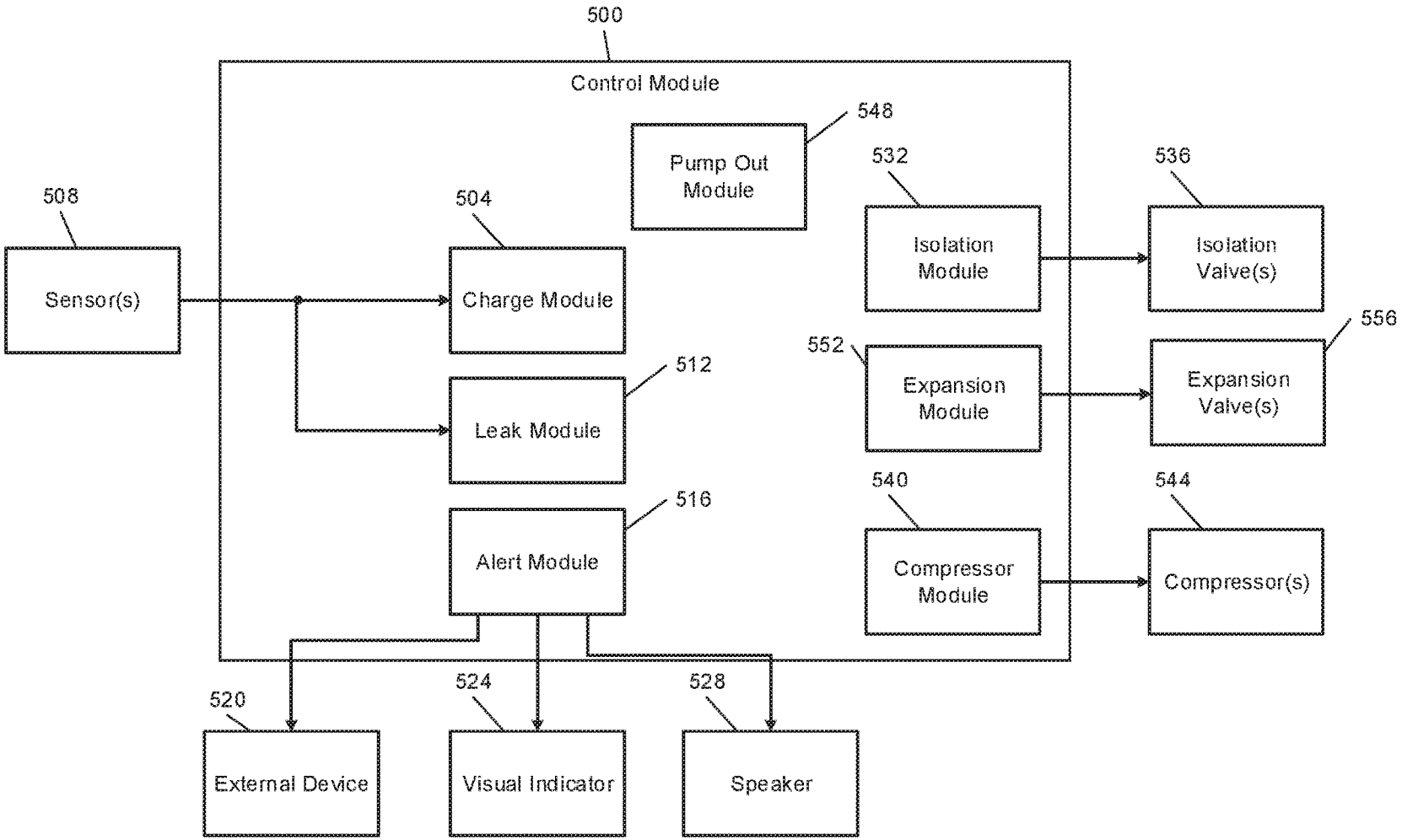
FIG. 15 is a functional block diagram of an example control system including a control module.

FIG. 15 is a functional block diagram of an example control system including a control module 500, such as one or more of the control modules discussed above. A charge module 504 determines the indoor charge amount, the outdoor charge amount, and/or the total charge amount, such as described above. The charge module 504 determines the amounts based on measurements from one or more sensors 508, as described above.

A leak module 512 diagnoses whether a leak is present, such as discussed above. The leak module 512 may determine whether a leak is present based on measurements from one or more sensors 508, the indoor charge amount, the outdoor charge amount, and/or the total charge amount, such as discussed above. An alert module 516 generates one or more indicators when a leak is present. For example, the alert module 516 may transmit an indicator to one or more external devices 520, generate one or more visual indicators 524 (e.g., turn on one or more lights, display information on one or more displays, etc.), generate one or more audible indicators, such as via one or more speakers 528.

An isolation module 532 controls opening and closing of isolation valve(s) 536 of the refrigeration system, as described above. A compressor module 504 controls operation (e.g., ON/OFF) of one or more compressors 544, as discussed above. The compressor module 504 may also control speed, capacity, etc. of one or more of the compressors 544. A pump out module 548 selectively performs pump outs, such as described above. An expansion module 552 may control opening and closing of one or more expansion valves 556, such as described above. The modules may communicate and cooperate to perform respective operations described above. For example, the isolation, expansion, and compressor modules 532, 552, and 540 may control the isolation valve(s), expansion valve(s), and compressor(s) as described above to determine whether a leak is present, for a pump out, etc.

The present disclosure further provides a method to control the operation of the elements including but not limited to the compressor 12, the expansion device 16, flow devices, or other components of a vapor compression system based on the operation of the isolation valves 20, 22 and a calculation of refrigerant charge where the thermostat or other control methods can be overridden (i.e. system shutdown) based on the charge calculation representing a leak is present.

The present disclosure also provides for a processing unit that controls the isolation valve sequence, the operation of elements including but not limited to the compressor 12, the expansion device 16, flow devices, or other components of a vapor compression system, and processes sensor inputs to calculate the system refrigerant charge. The processing unit has the ability to communicate (send and receive) with logging, diagnostics, monitoring, programming, debugging, database services or other devices. The processing can be performed locally to the condensing unit, locally to the furnace unit, remotely to the other processors in the HVAC/refrigeration system, and/or other remote processors.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A refrigerant control system, comprising:

a charge module configured to determine an amount of refrigerant that is present within refrigerant lines and a first heater exchanger of a refrigeration system within a building, wherein the charge module is configured to determine the amount of refrigerant within the first heat exchanger based on a volume of a combination of (a) the first heat exchanger located within the building and (b) the refrigerant lines, wherein the charge module is configured to, using measurements taken during a pumpdown operation, determine the volume of the combination of (a) the first heat exchanger and (b) the refrigerant lines based on a mass of refrigerant removed during the pumpdown operation and to determine the mass of refrigerant removed during the pumpdown operation based on a compressor displacement volume, a change in temperature, and a density of refrigerant at an outlet of the first heat exchanger, and an isolation module configured to selectively open and close an isolation valve of the refrigeration system and to, via the isolation valve, maintain the amount of refrigerant within the refrigerant lines and the first heat exchanger within the building below a predetermined amount of the refrigerant, wherein the pumpdown operation includes closing the isolation valve and operating the compressor.

2. The refrigerant control system of claim 1 wherein the refrigerant is classified as being flammable under at least one standard.

3. The refrigerant control system of claim 2 wherein the predetermined amount of the refrigerant is one of (a) specified in and (b) calculated according to at least one standard.

4. The refrigerant control system of claim 1 wherein the isolation valve is located between an output of a second heat exchanger located outside of the building of the refrigeration system and an input of the first heat exchanger located within the building of the refrigeration system.

5. The refrigerant control system of claim 4 wherein the isolation module is configured to at least partially close the isolation valve as the amount of refrigerant within the refrigerant lines and the first heat exchanger within the building increases toward the predetermined amount of the refrigerant.

6. The refrigerant control system of claim 4 wherein the isolation module is configured to at least partially open the isolation valve as the amount of refrigerant within the refrigerant lines and the first heat exchanger within the building decreases away from the predetermined amount of the refrigerant.

7. The refrigerant control system of claim 1 further comprising a second isolation valve located between an output of the first heat exchanger located within the building and an input of a compressor of the refrigeration system.

8. The refrigerant control system of claim 7 wherein the isolation module is further configured to at least partially close the second isolation valve as the amount of refrigerant within the refrigerant lines and the first heat exchanger within the building decreases away from the predetermined amount of the refrigerant.

9. The refrigerant control system of claim 1 wherein the charge module is configured to determine the amount of refrigerant within the refrigerant lines based on a second volume of the refrigerant lines of the refrigeration system.

10. The refrigerant control system of claim 9 wherein the charge module is configured to determine the second volume based on at least one temperature, at least one pressure, and the volumetric flow rate of a compressor.

11. The refrigerant control system of claim 9 wherein the charge module is configured to determine a volume of the first heat exchanger located within the building and the second volume based on a ratio of: (a) a rate of change of the amount of refrigerant within the refrigerant lines and the first heat exchanger of the refrigeration system within the building to (b) a rate of change of density of the refrigerant within the refrigerant lines and the first heat exchanger of the refrigeration system within the building.

12. The refrigerant control system of claim 1 wherein the refrigeration system does not include a refrigerant leak sensor located within the building.

13. The refrigerant control system of claim 1 wherein the isolation module is configured to selectively open and close two isolation valves of the refrigeration system and to, via the two isolation valves, maintain the amount of refrigerant within the refrigerant lines and the first heat exchanger within the building below the predetermined amount of the refrigerant.

14. The refrigerant control system of claim 13 wherein the isolation module is configured to selectively close the two isolation valves in response to a command to turn off a compressor of the refrigeration system.

15. The refrigerant control system of claim 13 wherein the isolation module is configured to open the two isolation valves in response to a command to turn on a compressor of the refrigeration system.

16. A refrigerant control method, comprising:

determining an amount of refrigerant that is present within refrigerant lines and a first heat exchanger of a refrigeration system within a building;

determining the amount of refrigerant within the first heat exchanger based on a volume of a combination of (a) the first heat exchanger located within the building and (b) the refrigerant lines;

using measurements taken during a pumpdown operation, determining the volume of the combination of (a) the first heat exchanger and (b) the refrigerant lines based on a mass of refrigerant removed during the pumpdown operation and determining the mass of refrigerant removed during the pumpdown operation based on a compressor displacement volume, a change in temperature, and a density of refrigerant at an outlet of the first heat exchanger;

selectively opening and closing an isolation valve of the refrigeration system; and via the isolation valve, maintaining the amount of refrigerant within the refrigerant lines and the first heat exchanger within the building below a predetermined amount of the refrigerant, wherein the pumpdown operation includes closing the isolation valve and operating the compressor.

17. The refrigerant control method of claim 16 wherein the refrigerant is classified as being flammable under at least one standard.

18. The refrigerant control method of claim 17 wherein the predetermined amount of the refrigerant is one of (a) specified in and (b) calculated according to at least one standard.

19. The refrigerant control method of claim 16 wherein the refrigeration system does not include a refrigerant leak sensor located within the building.

* * * * *